US008152504B2

(12) United States Patent
Didin et al.

(10) Patent No.: US 8,152,504 B2
(45) Date of Patent: Apr. 10, 2012

(54) METHOD OF OPERATION OF A SPHERICAL POSITIVE DISPLACEMENT ROTARY MACHINE AND DEVICES FOR CARRYING OUT SAID METHOD

(76) Inventors: Alexandr Vladimirovich Didin, Yaroslaskaya obl (RU); Ilya Yakovlevich Yanovsky, Krasnodar (RU)

( * ) Notice: Subject to any disclaimer, the term of this patent is extended or adjusted under 35 U.S.C. 154(b) by 498 days.

(21) Appl. No.: 12/319,348

(22) Filed: Jan. 6, 2009

(65) Prior Publication Data

US 2009/0185925 A1 Jul. 23, 2009

Related U.S. Application Data

(63) Continuation of application No. PCT/RU2007/000370, filed on Jul. 9, 2007.

(30) Foreign Application Priority Data

Jul. 10, 2006 (RU) ..... 2006124511

(51) Int. Cl.

| | |
|---|---|
| ***F01C 3/00*** | (2006.01) |
| ***F03C 2/00*** | (2006.01) |
| ***F03C 4/00*** | (2006.01) |
| ***F04C 18/00*** | (2006.01) |

(52) U.S. Cl. ..... 418/68; 418/1; 418/5; 418/107; 418/112; 123/18 R; 123/241

(58) Field of Classification Search ..... 418/1, 5, 418/68, 104, 107, 112, 153–155; 123/18 R, 123/241

See application file for complete search history.

(56) References Cited

U.S. PATENT DOCUMENTS

| | | | | |
|---|---|---|---|---|
| 143,723 A | | 10/1873 | Shaw et al. | |
| 826,985 A | | 7/1906 | Appel | |
| 1,904,373 A | * | 4/1933 | Kempthorne | 418/68 |
| 1,952,960 A | | 3/1934 | Kempthorne | |
| 2,318,386 A | | 5/1943 | Haines | |

(Continued)

FOREIGN PATENT DOCUMENTS

| | | |
|---|---|---|
| DE | 878 755 | 6/1953 |

(Continued)

OTHER PUBLICATIONS

International Search Report for PCT Appln. No. PCT/RU2007/000370 mailed Nov. 22, 2007 with English translation.

*Primary Examiner* — Theresa Trieu
(74) *Attorney, Agent, or Firm* — Holtz, Holtz, Goodman & Chick, PC

(57) ABSTRACT

A positive displacement rotary machine with a body having an internal spherical working surface divided into bypass and propulsion areas, a rotor with a working rotational surface, a ring working cavity formed by the working surfaces of the body and rotor, and a C-shaped separator mounted in part of the cavity at an angle to a plane of the rotor rotation. The cavity is partitioned by the separator at the bypass area, and the working medium openings are located from opposite sides of the separator. The working surface of the rotor has at least one slot. In each slot is mounted a piston capable of sealing the working cavity, and performing rotational oscillations in a slot plane. The piston is at least in the form of a part of a disk and has at least one through-cutout for the separator passage, and can seal the through-cutout at the propulsion area.

23 Claims, 21 Drawing Sheets

U.S. PATENT DOCUMENTS

| | | | | |
|---|---|---|---|---|
| 2,708,413 | A * | 5/1955 | Loewen | 418/68 |
| 2,832,198 | A | 4/1958 | Pichon | |
| 3,184,154 | A * | 5/1965 | May et al. | 418/68 |
| 3,408,991 | A * | 11/1968 | Davis | 123/18 R |
| 5,171,142 | A * | 12/1992 | Proglyada | 418/68 |
| 5,351,657 | A * | 10/1994 | Buck | 418/68 |
| 6,941,900 | B1 * | 9/2005 | Malinov | 123/18 R |
| 2009/0185937 | A1 * | 7/2009 | Didin et al. | 418/68 |

FOREIGN PATENT DOCUMENTS

| | | | |
|---|---|---|---|
| DE | 31 46 782 | A1 | 6/1983 |
| DE | 32 06 286 | A1 | 9/1983 |
| GB | 1 458 459 | | 12/1976 |
| GB | 2 052 639 | A | 1/1981 |
| RU | 2 134 796 | C1 | 8/1999 |
| RU | 2 301 345 | C2 | 6/2007 |

* cited by examiner

METHOD OF OPERATION OF A SPHERICAL POSITIVE DISPLACEMENT ROTARY MACHINE AND DEVICES FOR CARRYING OUT SAID METHOD

CROSS-REFERENCE TO RELATED APPLICATION

This application is a continuation of and claims priority from International Application PCT/RU2007/000370 filed Jul. 9, 2007, which claims the benefit of Russian Patent application No. RU 2006124511 filed Jul. 10, 2006, the entire disclosure of each of which is incorporated herein by reference.

FIELD OF THE INVENTION

The invention relates to mechanical engineering that is to positive displacement rotary machines which can be used as pumps, compressors, hydraulic drives and others, particularly in multistage submersible units.

BACKGROUND OF THE INVENTION

A positive displacement rotary machine (PDRM) (RU 2004133654) having a body with an internal ring cavity is known. A spiral separator with a rotor inside is installed in this cavity. The rotor working surface is a surface of rotation, where there is at least one slot along the rotation axis of the rotor, in each of which a piston partly extending (projecting) from one side of the rotor is rotatably mounted. Besides, the piston has at least one through-cutout across its perimeter interacting with the separator for the piston and the rotor rotation synchronization. The machine inlet and outlet openings are spaced along the rotor axis and separated from each other by the separator. The piston of such a machine rotates in the same direction relative to the rotor and together with the rotor rotates relative to the body.

Such machine has the following advantages.

The piston is securely installed in the rotor slot extending from it for about a halfway. The inlet and outlet openings spacing configuration along the rotor axis facilitates combination of such machines into multistage machines including those with a common rotor for multiple stages. Such machines are used in submersible units. The common rotor enables the reduction of radial load and often thrust load on the bearings of the rotor by balancing the loads on the individual stages in case the stages are turned relative to each other.

An essential advantage of the pump, produced on the basis of this machine, is the uniform flow rate.

Disadvantage of such machines is a complicated configuration of the separator and the piston through-cutout that does not allow contact between them over a large area in order to reduce wear of the friction pair (to reduce an ideal load on the friction pair and extend its service life).

A PDRM is known (GB 1458459 and similar to it DE 3206286 A1), the body of which contains a cavity in the form of a spherical segment, in which a separator shaped as a sector of a circle is installed along the axis of symmetry of the cavity dividing the cavity; a rotor installed inside the body and capable of rotation has the working surface in the form of two truncated cones resting with their tops on a sphere from the opposite sides, while on the surface of the sphere, at an angle to the axis of symmetry of the rotor, there is a circular groove positioned tangentially with respect to both cones. A piston with a through-cutout, allowing the passing through of the separator, is rotatably mounted in this groove. The piston interacts with the separator through a sealing synchronizing element (SSE), embodied in the form of a cylinder sectioned in half by a through-cutout, which begins at one end and extends most of the way to the other end. The working medium inlet opening and corresponding outlet opening are located on the same side of the piston. On the other side of the piston there is one more pair of inlet and outlet openings. The piston of such machine swings relative to the body and the machine rotor rotates relative to the swinging piston.

Such a machine has the following advantages: a good contact of the piston with the body chamber along the spherical surface, a good contact between the piston, the sealing element and the separator, simple geometrical forms: the flat separator, the flat piston and others.

PDRM also has disadvantages: the difficulty of combining such a machine into a multistage machine, associated with the fact that the inlet and outlet openings are located on the same side of the piston, and in order to get from one stage to another, a channel is required bypassing the spherical cavity of the body along the rotor axis. Also considered as disadvantages are: non-uniform flow rate, weak mounting of the piston (which is only partially located inside the groove on the sphere), which also weakens the shaft due to the circular groove, unreliable mounting of the sealing synchronizing element in the through-cutout of the piston (jamming is possible under increased loads).

The PDRM (DE 3146782 A1), having a body with a cavity in the form of a segment of a sphere and a rotatably mounted rotor with through-slot along the rotor axis, is known. There is also a piston in the form of a disk rotatably mounted in the rotor slot, a chamber in the form of spherical segment partitioned by a separator in the direction of the rotor rotation as well as outlet and inlet openings located in front of and behind the separator accordingly. Besides, the piston rotation is synchronized with the rotor rotation by means of a shaft, fixedly going through the rotor, and the system of gears, one of which is fixed at the piston. The piston of such a machine rotates in the same direction relative to the rotor and, together with the rotor, rotates relative to the body.

Advantages of this machine include spherical contact between the piston and the chamber, reliable mounting of the piston extending towards both sides from the shaft, presence of a strong shaft (longitudinal slot barely weakens it), possibility to arrange (to space) the inlet and outlet openings along the shaft to combine several stages on one shaft, independence of leakage (slippage) on the wear of synchronizing mechanism, and possibility of high rotational speed.

Unreliable synchronizing mechanism, especially in case if the gear shaft is required to pass through several stages, is referred to as disadvantage.

A new kind of pumps (drives, compressors), which is expected to be used in many fields (from oil and gas production, transport up to domestic needs), is declared by this application; below different embodiments of the machine components of the same function, meeting different requirements for manufacturing costs, reliability, service life and tightness are given. As the PDRM is designed to operate using different working liquids (from high-viscosity liquid with abrasive to gas), with different flow rates (size), at different speed, different methods of its operation (methods of the piston through-cutout closing off at the propulsion area) are claimed. A variety of embodiments is also associated with different capabilities of potential manufacturers.

Further is the description of the PDRM type, which appeared due to using a new operation method of the spherical PDRM (field of method applicability).

The purpose of this application is to describe the operation method of the spherical PDRM (having a body with a cavity in the form of a spherical segment, a part of which represents a working chamber surface), which allows making the flow rate of such a machine almost uniform (non pulsating) throughout the cycle and spacing working medium inlet and outlet openings along the axis of the machine rotor rotation (the latter allows convenient combining the separate stages of the PDRM into a multistage unit with the common rotor for an application in downhole submersible plants). The characteristic feature of this PDRM is the presence of at least one piston mounted in the rotor slot and performing rotational oscillations relative to the rotor and, together with the rotor, rotating in the same direction relative to the body. Structurally, such movement of the piston is provided for by the fact that a separator, partitioning a circular working chamber formed between the body and the rotor, is fixed inclined to the plane of the rotor rotation, and the rotor slot for the piston has the larger angle of inclination to the plane of the rotor rotation than the separator does. In most embodiments, the slot is located along the rotor axis. In the simplest case, the piston is a flat disk with a spherical side surface, the diameter of which is almost equal to the diameter of the body spherical cavity. However, (see below) the piston of differing thickness by radius and/or angle has to be used as well as a part of disk, for example, in the form of a truncated sector or disk with hollows in separate places can be used as the piston to improve some features. This is required, for example, to make possible of multiple piston installation, reduction of gaps by means of centrifugal forces, the piston weight-reduction due to removal of unused sections and so on. When using the piston in the form of a whole disk, the rotor slot for the piston is made to be through and the piston has two through-cutouts for the separator, located at approximate diametrically opposite ends of the piston. When using the piston in the form of a sector of a disk, the rotor slot for the piston can be made blind (it results in an increase of the machine flow rate), and the piston has one through-cutout for the separator. In the simplest case, the separator represents a flat washer, a working part diameter of which (it does not include the washer attachment to the body) is almost equal to the diameter of the body cavity and on the area of which through-passes (holes, slits) from one side (plane) of the washer to the opposite side are made. In extreme case, about a half of the washer is absent and one large pass is made in its place. This extreme case is logically to be referred to the same type of the machines and the area, left from the separator, is to be called the washer area, as the separator configuration is provided for by the piston through-cutout path, which still remains closed. Besides, the piston through-cutout traces out a closed path, running just around the rotor unlike, for example, principally spiral (about circular axis of torus) path of the piston through-cutout according to application RU 2004133654 and unlike the other applications, where the through-cutout swings relative to the body. However, in some cases (see below), deviations from the flatness of the separator are useful. The simplest deviations are associated with a change of the washer thickness along its radius. They are associated with its strength properties and the strength properties of the mating parts as well as with the working cavity space saving. In some cases, a change of thickness along the circle is used and, rarer, to optimize inclination angles relative to tile piston or the piston speed at different portions of the machine cycle the washer deviation from flatness is used. The piston can be equipped with the seal synchronizing element (SSE), a part of which projects into one or both through-cutouts of the piston. It is referred to as the synchronizing element since it transmits a force from the separator to the piston to provide synchronization of the latter, and as the seal element since, having a higher possibility of tracing the inclination angle of the separator due to additional degrees of freedom, it provides a closer contact with the separator along the larger area. The SSE is logically to be considered as a part of the piston. Finally, one more deviation is the body cavity deviation from a spherical form, which is associated both with tolerances for manufacturing, allowances for possible system clearances (for example, for the shaft axial clearance) and with deviations from spheroid resulting in an increase of some characteristics because of the others. Thus, at several pistons in the form of the sector of a disk, the machine flow rate can be increased due to modifying the sphere into a barrel and, further, even into a cylinder. Besides, other features are smoothly changed: at first, the piston contact with the body wall gets worse and then becomes better on drawing near to the cylinder, the piston inertial load increases.

The main factors influencing the form and dimensions of the PDRM parts.

The rotor of this PDRM shall be solid (made as one rigid unit) for its adaptability to manufacture and in order to get maximum pressure (especially, in the multistage embodiment, when, via the rotor of the first or the last stages, maximum torque is transmitted from drive to all the rest stages). When possible, a slot for the piston is arranged, mainly along the axis of the rotor rotation, and made flat. The slight deviations in the slot angle and flatness are possible to provide the piston support area distribution for optimization of friction forces moment acting on the piston. The piston can be self-adjustable in such slot. That is, the rotor is mounted in the PDRM body due to its bearings and/or, for example, due to the spherical or other surfaces. Irrespective of the rotor, the piston is mounted in the PDRM machine (by the coordinate along the rotor axis and by the coordinate along the piston radius perpendicular to the rotor axis) supported by the body spherical surface and by the coordinate along the piston geometrical axis it is supported by the rotor slot. At such a mounting, requirements for the accuracy of the piston positioning in the rotor significantly decrease as well as the gaps, required for the machine operation, also decrease.

Besides, the piston is not desirable to be made too thick. As the piston thickness increase results in the rotor strength decrease as well as the piston torque increase over the required value, at the same time, reducing the machine flow rate (if additional actions, making the machine design more sophisticated and limited, are not taken).

The separator thickness decrease at the propulsion area of the body results in the machine output increase. At this area, the separator is, mainly under a light longitudinal load, while at the bypass area (where it separates the working medium inlet opening from outlet opening) it is under a large transverse load. The separator thickness at the bypass area of the body does not influence the machine output.

Only the ascending area of the separator, located at the bypass area, is used for its title-specified purpose (to separate the chambers of different pressure). Its descending area, located at the propulsion area of the body, to the contrary, shall pass the whole working medium flow through.

At the piston through-cutout sealing by means of the seal synchronization element (SSE), the geometrical axis of which goes through the piston center (the sphere center), the part of this element, projecting into the working chamber, shall be cut in two by the through-cutout to enable the separator to pass through; therefore, a sufficient area for secure fixing of these parts to a common base shall be provided for. The SSE shaft shall also be strong enough to withstand inadvertent overloading, caused by potential mechanical impurities ingress into the machine or temporary change of working medium properties.

Since the separator thickness increase (especially, in its central part) has a negative effect on the SSE strength, its thickness is desirable to be reduced. But the maximum pressure of the machine is determined by the strength of the separator (especially, of its ascending area). Therefore, a task of optimal partitioning of the separator into parts as well as maximum strengthened (rigid) connection of these parts arise. Besides, the separator flatness is desirable for adaptability to manufacture and manufacturing accuracy.

There are contradictory requirements in the fact that the SSE shaft shall be located inside the piston (not going beyond its thickness) and the base for fixing two projecting parts of the SSE is also desirable to be located inside the piston.

In the first PDRM embodiment, the piston through-cutout at the propulsion area is closed off by the descending area of the separator, on which the passes for working medium flow to the other side of this descending area are made. Moreover, angular dimension of the passes along the movement of the piston is limited (otherwise, the separator does not close off the piston through-cutout) resulting in working medium flow resistance increase. Later, another way of providing the piston through-cutout tightness at the propulsion area was found. The multiple means for the piston through-cutout closing off due to introduction of additional elements turned out to exist. In this application, only some of them are considered to illustrate the new method. Due to using the new method, angular length of the passes for working medium flow was significantly increased. In the limiting case, one large pass is made throughout the descending (propulsion) area of the separator.

The assigned task is achieved due to the fact that at least one portion of the piston through-cutout at the propulsion area is closed off by means of the additional elements, hereafter referred to as shutters, besides, the separator does not take part in the piston through-cutout closing off at this area. This results in increase of the working medium pass size, reducing the machine hydraulic resistance. And in many cases, this produces wear margin for the through-cutout and the separator, excluding the occurrence of the gap leakage.

The method is based on the fact that the height of the through-cutout is much smaller than the height of the machine chamber. Therefore, the shutter can be small as well as can perform slight rotational oscillations relative to the piston.

At small pressure differentials, the separator can be thin enough and thus, the piston through-cutout can also be thin. For the high-speed machine, there can be no need in the through-cutout mechanical closing off. Its hydraulic resistance is sufficient for this purpose. The optimal through-cutout entry and exit form is well known from the reference books.

The simplest means for the piston through-cutout closing off is sealing it by means of the flexible resilient member. Such a sealing is well suitable at small thickness of the separator (at small pressure differentials on the machine stage). The presence of the SSE in the through-cutout improves the conditions for performing such a sealing. Then, the sealing is mounted in the SSE through-cutout.

The following method is suitable for a high pressure as well. This is the mechanical shutter which rotates around the piston axis or close to it. There are several methods to control such a shutter.

1) The shutter has a tendency to be in a closed position due to centrifugal forces and/or the resilient members as well as due to forces coming from the liquid pressure differential on the piston. Besides, it has an elongated chamfered lug, by which it interacts with the projecting sharp end of the separator, resulting in its opening in due moment of time. Impact force can be reduced to a minimum (to zero) by the form of the lug and a chamfer. Flexible materials can be used for these parts. The shutter is desirable to be pressure unloaded before impacting. For this purpose, a recess, passing through which the piston loses tightness, is made in the body. Unreliability of closing and impacts resulting from the presence of the clearances in the system are referred to as disadvantages.

2) The shutter lug moves all the time inside a guide groove, made on the body spherical surface, and entirely regulates the shutter position. The disadvantage is that the groove presence results in increase of the machine diameter (it is important for submersible embodiments) and leads to abrasive accumulation in it and rubbing of the lug. The lug rubbing results in seal deterioration.

3) The position of the shutter is controlled by a guide, situated along the body at the propulsion area. The disadvantage is that the piston through-cutout shall also pass this guide through; therefore, it is bigger in size which results in increase of the shutter size and its load. A wear of the shutter cutout and the guide results in the seal deterioration.

4) The shutter is controlled by the angle of the separator, located from the opposite side of the piston. For example, when the SSE, the axis of which goes through the piston center at right angle to the piston axis, acts as the shutter. The disadvantage is that along a sufficiently large transition area the angle of the separator is changed slowly delaying the closing off process.

5) The shutter is controlled by the thickness of the separator, located from the opposite side of the piston. The disadvantage is that it results in an increase of the separator thickness, the piston through-cutout height and the shutter dimensions.

6) The most interesting case is, when the shutter is controlled by the piston position relative to the rotor. The shutter is required to be brought into open position just at one point—at the place of the maximum deviation of the piston through-cutout, for example, downwards (if the shutter is located higher than the through-cutout is). In all the other positions, it is closed provided that it is not positioned at the separator. The advantage is that the piston speed relative to the rotor is not high (it is equal to zero at the center) and this place is protected against abrasive to a greater extent (by means of centrifugal forces, seals). The simplest way of controlling is to make a groove in the form of an arc near the axis of the shutter and to mount a pin (stop) in the rotor. When the shutter, together with the piston, comes to the position of the separator entry, the pin reaches the end of the groove and the shutter stops, but the piston can turn further.

The assigned task is achieved by making the SSE base conical.

The assigned task is achieved by making the chamfers (rounding) between the SSE through-cutout bottom and its side surfaces.

The assigned task is achieved by making the SSE through-cutout profile and, therefore, the separator profile thinner towards the machine center.

The assigned task is achieved by making the chamfers at the place where the rotor slot for the piston opens on the central sphere. As a result, stronger base of the SSE can be located in the space emerged.

The assigned task is achieved due to decrease (making the recess along a fin) at the joint of the rotor slot for the piston and the central sphere. As a result, stronger base of the SSE can be located in the space emerged.

The assigned task is achieved due to mounting the special washer, acting as sealing between the SSE, the piston and the rotor, into the piston through-cutout.

The assigned task is achieved by making the SSE part, projecting into the working chamber, in the form of a body of rotation (for example, cylinder plus cone or sphere), diameter of which is greater than the diameter of the SSE shaft.

The assigned task is achieved due to composing the piston of at least two parts (division can go along its end surfaces) at least on one of which a boss (increased thickness) is made, and there is a cavity for this boss in the rotor slot. It is different from the standard piston thickness increase in that it is hidden inside the rotor and its movement together with the piston along the rotor slot during the piston self-positioning does not result in increase of the gaps between the rotor and the piston.

The assigned task is achieved due to the separator partitioning into unequal parts (which is somewhat different from the conventional division into the ascending and descending areas). Besides, the ascending part is larger than the descending one. Moreover, the through passes can also be partly located at the ends of the ascending part.

The assigned task is achieved by making the SSE solid with its shaft, intersecting the chamber center. Moreover, the piston is made prefabricated, consisting of at least two parts (partitioning can go along its end surfaces).

The assigned task is achieved due to the fact that the lug is made in the region of the through-cutout bottom on the piston, and the rotor slot is enlarged in the center for allowing this piston lug passing through at assembly. The rotor slot enlargement area can be closed off by an additional member—an insert of the rotor, which is inserted in the rotor together with the piston. Additionally, in order to strengthen the piston, the boss can be made in its center. In this case, a recess or a through hole for the boss is additionally made in the rotor insert.

THE INVENTION IS DESCRIBED BY MEANS OF DRAWINGS

FIG. 1 shows an isometric view of the stage of a positive displacement rotary machine with the descending (called according to the direction of the piston through-cutout travel at a progressive rotation of the rotor) propulsion part of the body placed aside (besides, to facilitate understanding, the corresponding descending part of the separator is left). A stator of the machine consists of two longitudinal halves.

Figure 1:
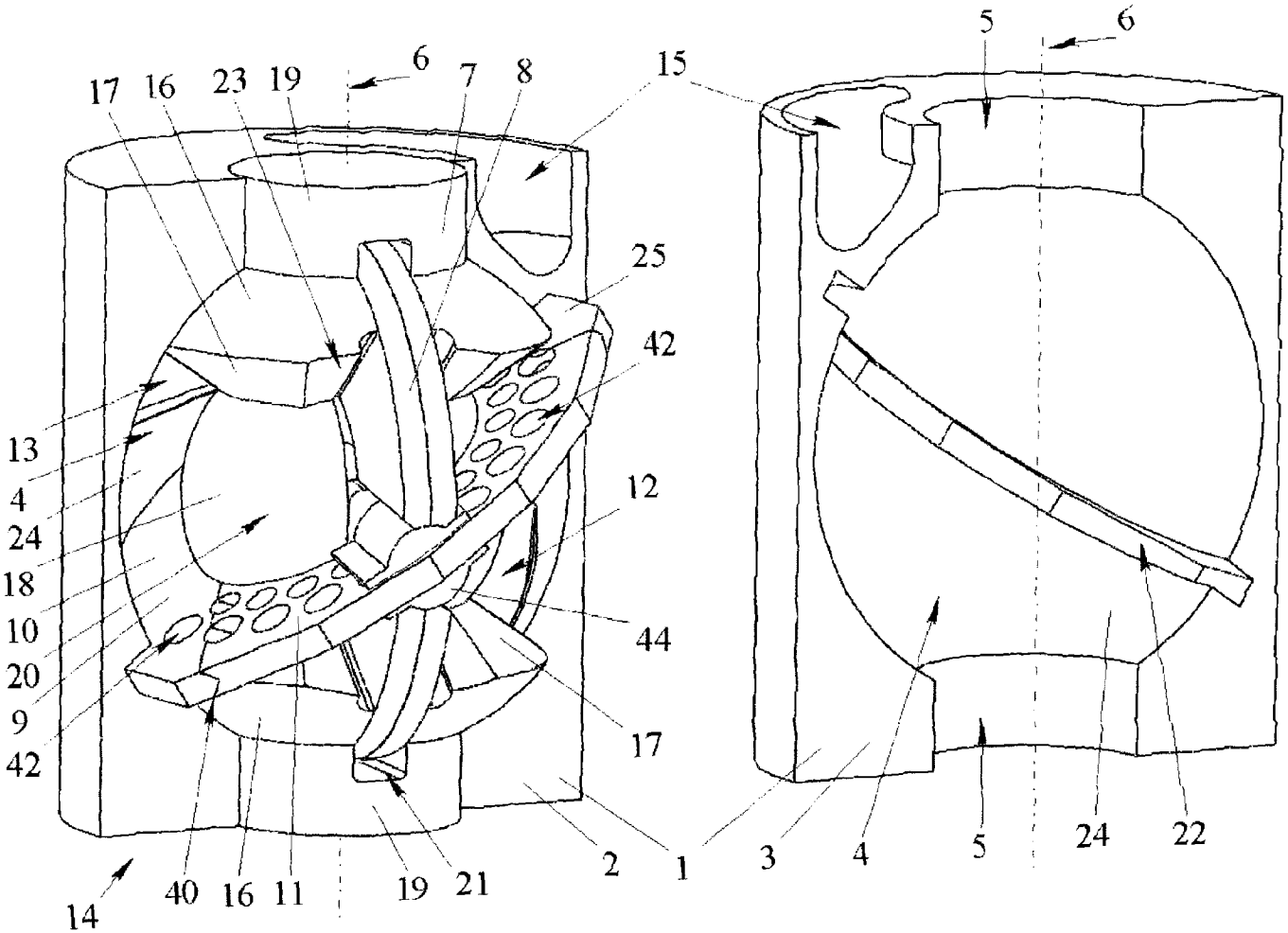
Figure 18:
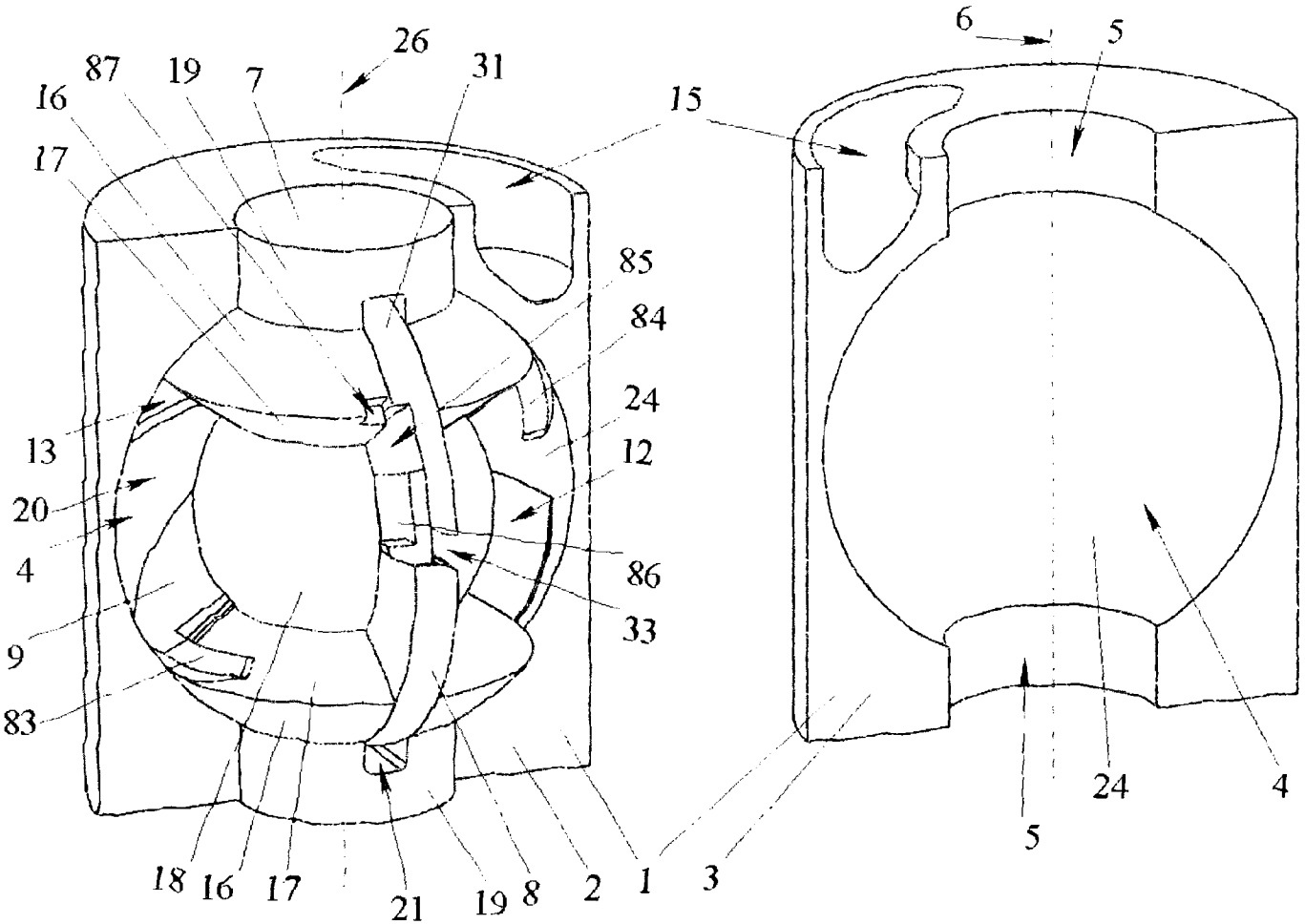
FIG. 18 shows an isometric view of another embodiment of the PDRM of FIG. 1, where the piston through-cutout is closed off by the shutter at the propulsion area.
Figure 20:
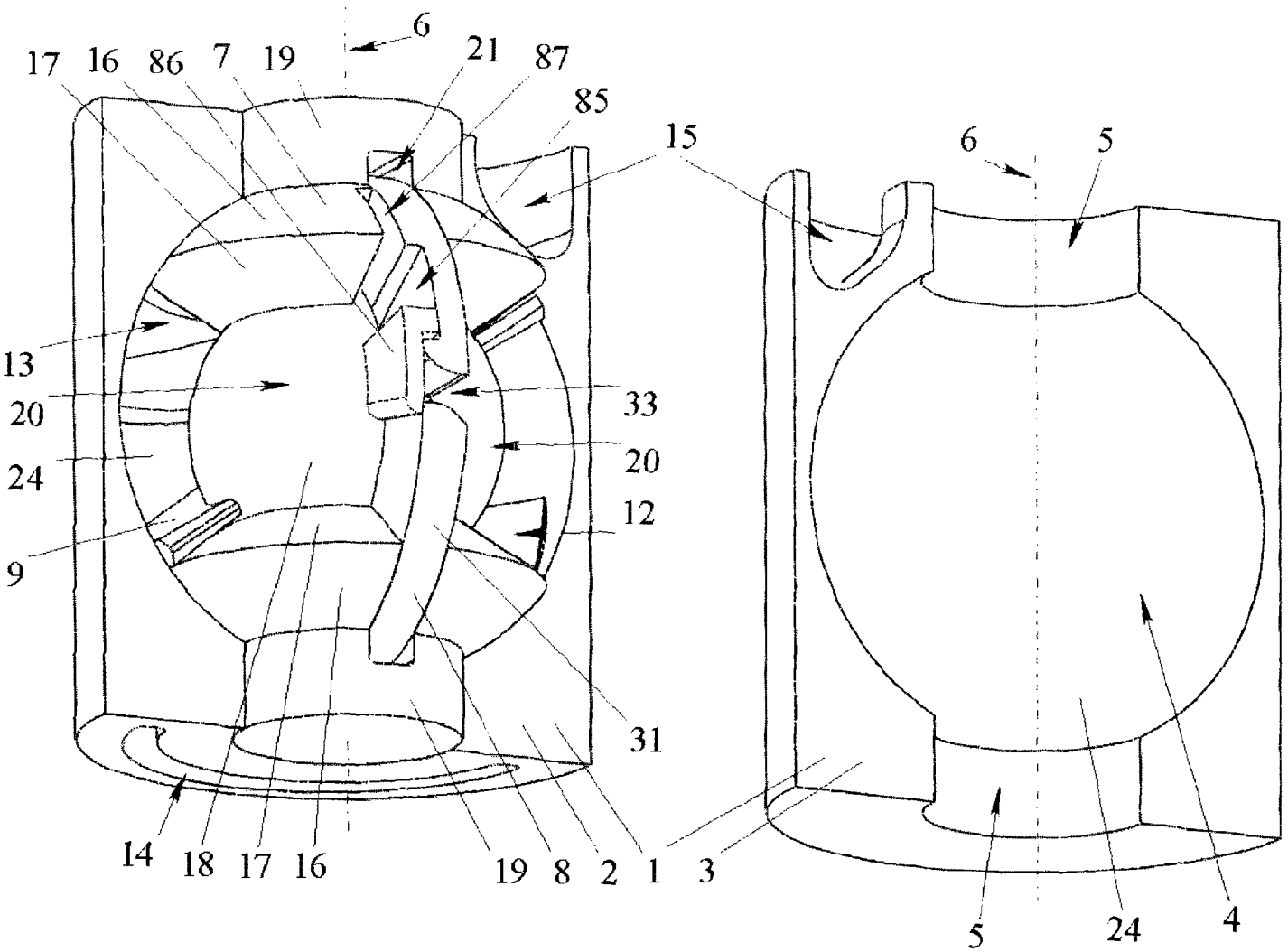

FIG. 20 isometrically shows another embodiment of the PDRM of FIG. 1 and FIG. 18, where the piston through-cutout is closed off by another embodiment of the shutter at the propulsion area.

Figure 21:
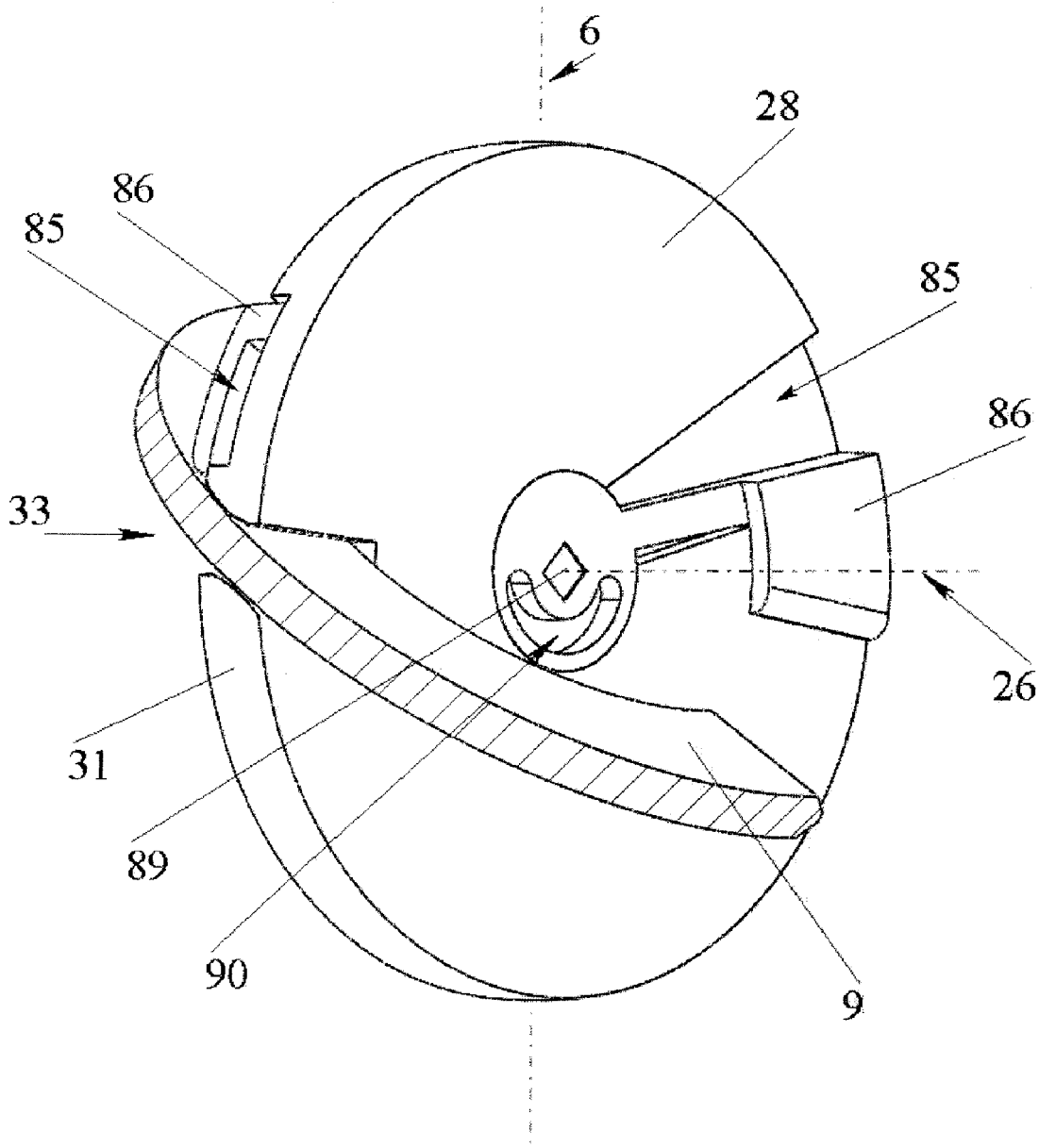

FIG. 21 shows an exploded view of the PDRM embodiment of FIG. 20, consisting of the separator, the piston and the shutters.

The elements similar in function are designated by the same numbers on all the figures, where:

1—body;
2—body part, ascending half;
3—body part, descending half;
4—spherical cavity;
5—concentric hole for rotor shaft outputs;
6—machine geometrical axis;
7—rotor;
8—piston;
9—separator;
10—ascending (bypass) part of separator;
11—descending (propulsion) part of separator;
12—inlet opening;
13—outlet opening;
14—duct without flow turning around body;
15—duct for flow turning around body;
16—spherical part of rotor above cone;
17—rotor surface in the form of a truncated cone;
18—central spherical part of rotor;
19—rotor shaft output;
20—working cavity;
21—rotor slot for piston;
22—body slot for separator;
23—rotor recess for SSE;
24—body spherical surface;
25—separator flat (conic) surface;
26—piston geometrical axis;
27—piston shaft;
28—piston flat part;
29—piston central thickened part;
30—piston through hole for SSE;
31—piston spherical side surface;
32—SSE geometrical axis;
33—piston through-cutout for separator;
34—piston end-face;
35—piston through-cutout bottom;
36—piston through-cutout side surface;
37—cylindrical surface on piston through-cutout side;

38—conical part of hole in piston through-cutout for SSE base;
39—piston cylindrical hole for SSE;
40—separator joint;
41—separator inner spherical surface;
42—separator through pass;
43—chamfer, connecting piston end-face with cylindrical surface on piston through-cutout side;
44—seal synchronization element (SSE);
45—SSE through-cutout for separator;
46—SSE lugs;
47—pin;
48—SSE flat or conical area;
49—SSE through-cutout side surface;
50—SSE through-cutout bottom;
51—SSE spherical end;
52—SSE conical base;
53—SSE shaft;
54—SSE shaft hole for pin;
55—chamber between SSE through-cutout bottom and SSE through-cutout side surface;
56—SSE inner spherical surface;
57—piston hollows for weight-reduction;
58—rotor slot flat surface;
59—rotor slot flat surface recess;
60—SSE cylindrical part.
61—chamfer at the joint of rotor central sphere and rotor slot;
62—piston hole of smaller diameter for SSE pin;
63—piston boss for its strengthening;
64—hole for rivet;
65—washer to be mounted into piston through-cutout;
66—washer flat (conical) side;
67—washer cylindrical bottom;
68—washer spherical top;
69—washer conical hole;
70—washer side mating with piston through-cutout;
71—groove at the joint of rotor central sphere and rotor slot;
72—chamfer at the joint of rotor central sphere and its conical part;
73—conical part of SSE body of rotation;
74—chamfer at separator inner part;
75—piston lug for SSE through-cutout closing off;
76—separator exit;
77—piston lug for SSE base;
79—resilient member in SSE through-cutout;
80—insert in the shaft;
81—separator entry;
82—rotor contact area;
83—separator entry for shutter;
84—separator exit for shutter;
85—piston cutout for shutter;
86—shutter;
87—rotor recess for shutter;
88—shutter lug;
89—shutter shaft;
90—shutter groove for stop pin;
91—resilient member for shutter drive.

DESCRIPTION OF THE MACHINE BEST EMBODIMENT

A stage (which can be used separately as well) of the positive displacement rotary machine (FIG. 1) is structured as follows. A body 1 (FIG. 1, 13), made of two parts, conventionally called the ascending (bypass) half 2 and the descending (propulsion) half 3, contains a cavity 4 in the form of a segment of a sphere (rather a segment of a torus, which is formed instead of the sphere resulting from tolerances for the rotor axial clearance) with two holes 5, concentric with it. A separator 9 (FIG. 1, 3), made in the form of a washer with the inner spherical hole 41, is mounted in the spherical cavity 4 at an angle to the hole 5 geometrical axis which is the machine geometrical axis 6. By functions, the separator 9 can be conventionally divided into two areas: the ascending (bypass) 10 running upwards at the bypassing of the rotor from right to left, and the descending (propulsion) 11 running downwards at the bypassing of the rotor from right to left. Although for strength, it is made of two parts not coincidental with the functional division, for the sake of simplicity they will be referred to in the same way. Both parts 10 and 11 of the separator are fixed to the corresponding parts 2 and 3 of the body. In this embodiment, they are inserted in the slots 22 at both parts of the body. The through passes 42 to the other side of the separator 9 are made at one of the separator 9 areas, at the descending area 11. The rotor 7 with the working surface, made in the form of two surfaces of the truncated cones 17 resting with their smaller bases against the central sphere 18 (FIG. 1), is mounted in the body 1 rotatably around the axis 6 of the body 1.

Figure 2:
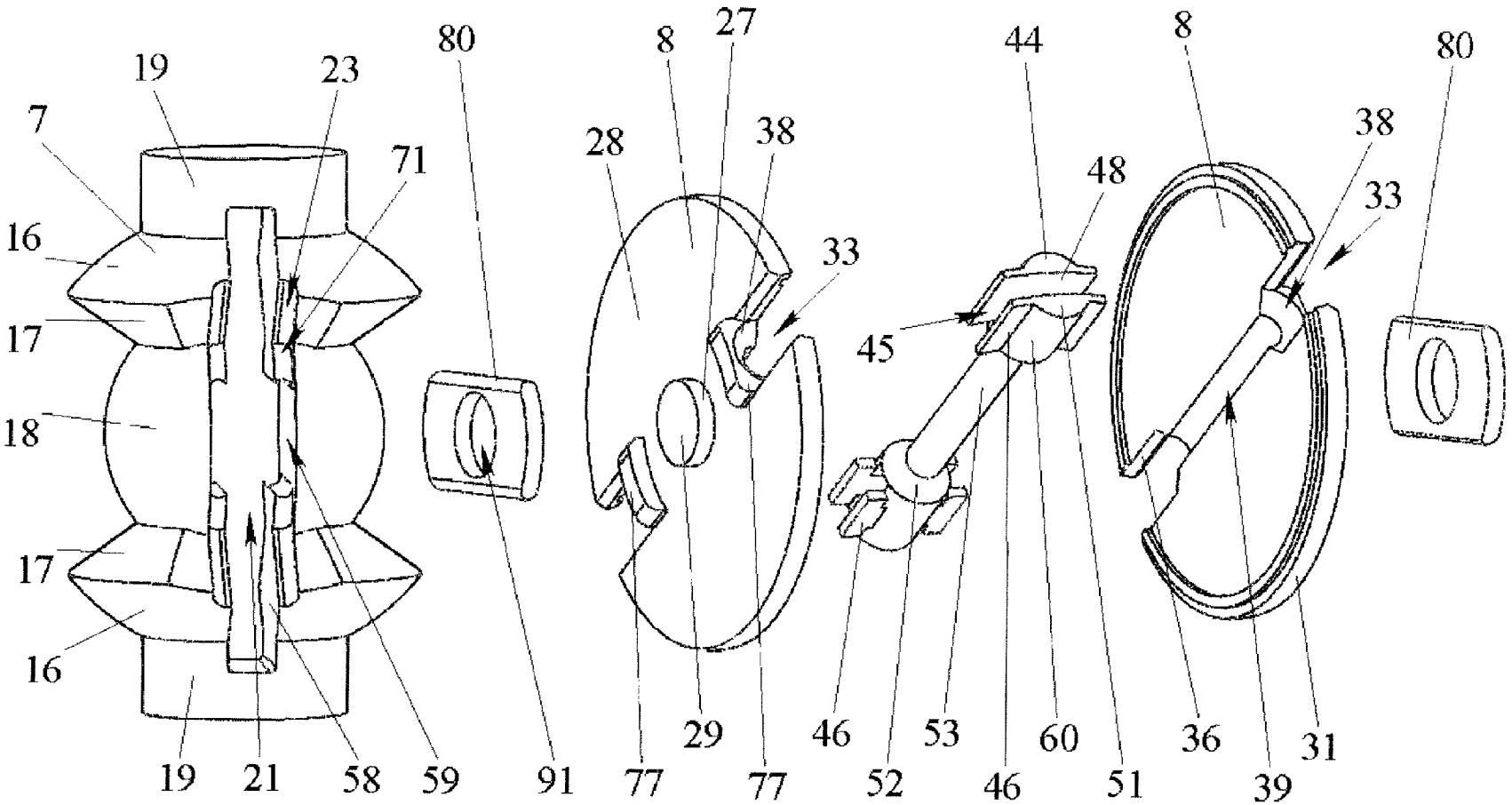
FIG. 2 shows an exploded view of a block consisting of the rotor, the rotor insert, the piston and the SSE.
Figure 3:
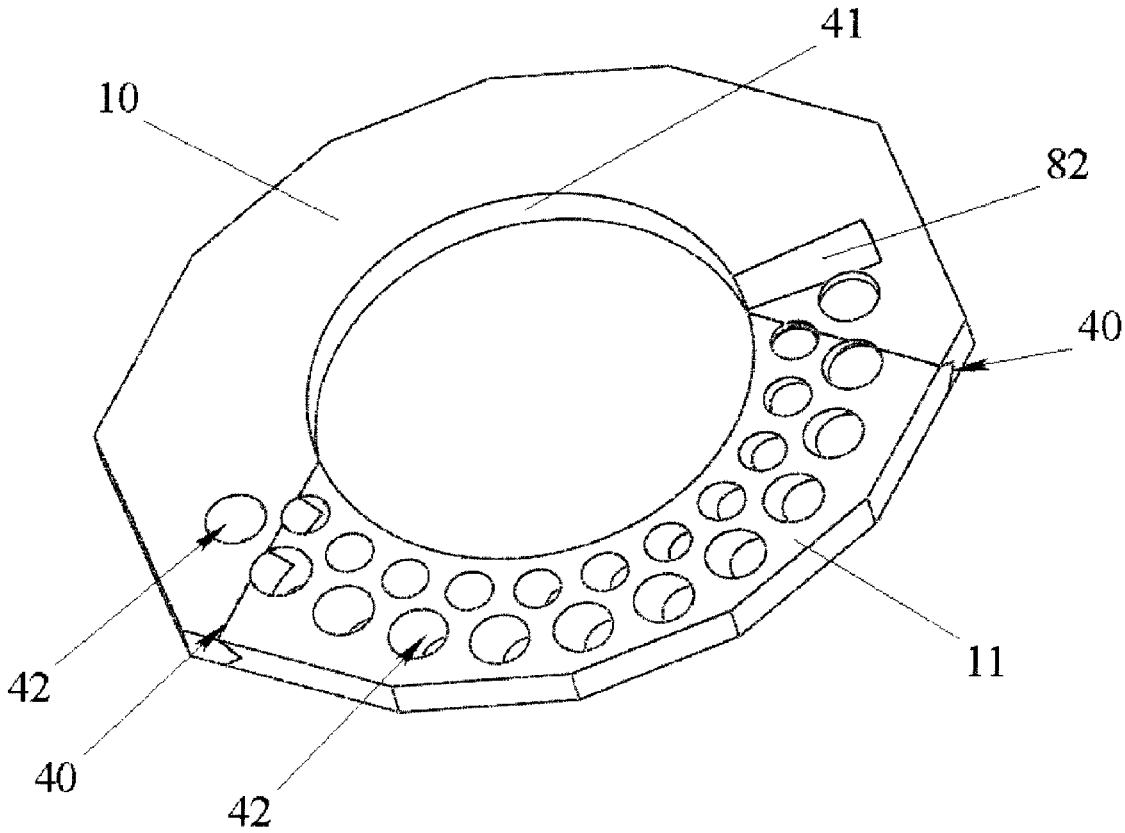
FIG. 3 shows an isometric view of the separator.

The lager bases of the cones are connected with the concentric to them outputs 19 of the shaft, by segments 16 of the sphere, concentric to the central sphere 18 with radii approximately equal to the radius of the working cavity 4. On the working surface of the rotor 7 there is a through slot 21 along the machine geometrical axis 6 (FIG. 1). To enable the assembling, in the slot 21 on the flat surface 58 a recess 59 is made in which the insert 80 is inserted (FIG. 2). The working cavity 20 is formed by the body spherical part 4, the rotor conical part 17, the rotor central spherical part 18 and by the separator 9 (FIG. 1) which partitions it into two parts. The separator 9 touches the rotor 7 conical surface 17 with its opposite sides in two diametrically opposite places (FIG. 1). These touchdown places approximately limit the ascending 10 and descending 11 areas of the separator 9. The conical recess 82 is made in touchdown place to increase contact area. A groove can be made in front of the recess 82 (in front of touchdown place) to prevent abrasive ingress (not shown).

The piston 8 (FIG. 1), projecting from the through slot 21 in both sides, is mounted in the slot 21 with capability of rotational oscillations around the geometrical axis 26, intersecting the machine geometrical axis 6 at right angle (in other words, in the plane of the slot 21). The piston 8 is made in the form of a disk having the flat 28 and central thickened 29 parts (FIG. 2). There are two diametrically opposite through-cutouts 33 at the flat part 28 (FIG. 2). The lugs 77 are made at the piston flat part 28 in the region of the through-cutout 33 to increase the piston 8 thickness in this place. The through hole 39 is made in the through-cutout 33 along the diameter. It has conical entries 38 of a shallow depth. The piston 8 is made prefabricated of two disk-like parts. In the hole 39 of the assembled piston 8 the SSE 44 made in the form of two cylinders 60 connected by the shaft 53 is mounted. The end of each cylinder 60 is cut through by the through-cutout 45 for the separator 9 (FIG. 2). To increase the area of the through-cutout 45 side surface 48 the lugs 46 (FIG. 2, 14) are made at one of the cylindrical SSE parts 60 cut by the through-cutout 45. To enable assembling, such lugs 46 are inserted into another cylindrical part 60 of the SSE 44 as plates. There are the working medium inlet 12 and outlet 13 openings located from the opposite sides, under and above the ascending (bypass) area 2 of the separator 9 accordingly (under or above is in the direction of the rotor 7 axis at figures), and adjacent to touchdown place of the separator 9 and the rotor 7 (FIG. 2). Besides, the openings 12, 13 can lie along the whole angular length of the ascending area of the separator 9 and even overlap the areas 82 of the separator 9 contact with the rotor 7 conical surfaces 17. The PDRM assembling procedure is as follows. The SSE 44 is mounted in the hole 39 between two parts of the piston 8. The piston 8 parts are firmly joined together by any known means (screws, rivets, welding). The inserts 80 are placed on the piston 8 from the both sides. The whole assembly is inserted into the slot 21 of the rotor 7. Moreover, the inserts 80 can enter the recess 59 freely or by pressing-in. Then, the assembled block is enclosed between the two halves 2 and 3 of the body 1, having the parts 10 and 11 of the separator 9 inserted in them. Further, the body 1 can be just tightly inserted into the pipe (the standard procedure of multistage submersible pump assembling) or the parts 2 and 3 are fastened to each other by any known means (screws, rings).

In order to make the PDRM more adaptable to manufacture (for mass production), it can be changed as follows.

Figure 4:
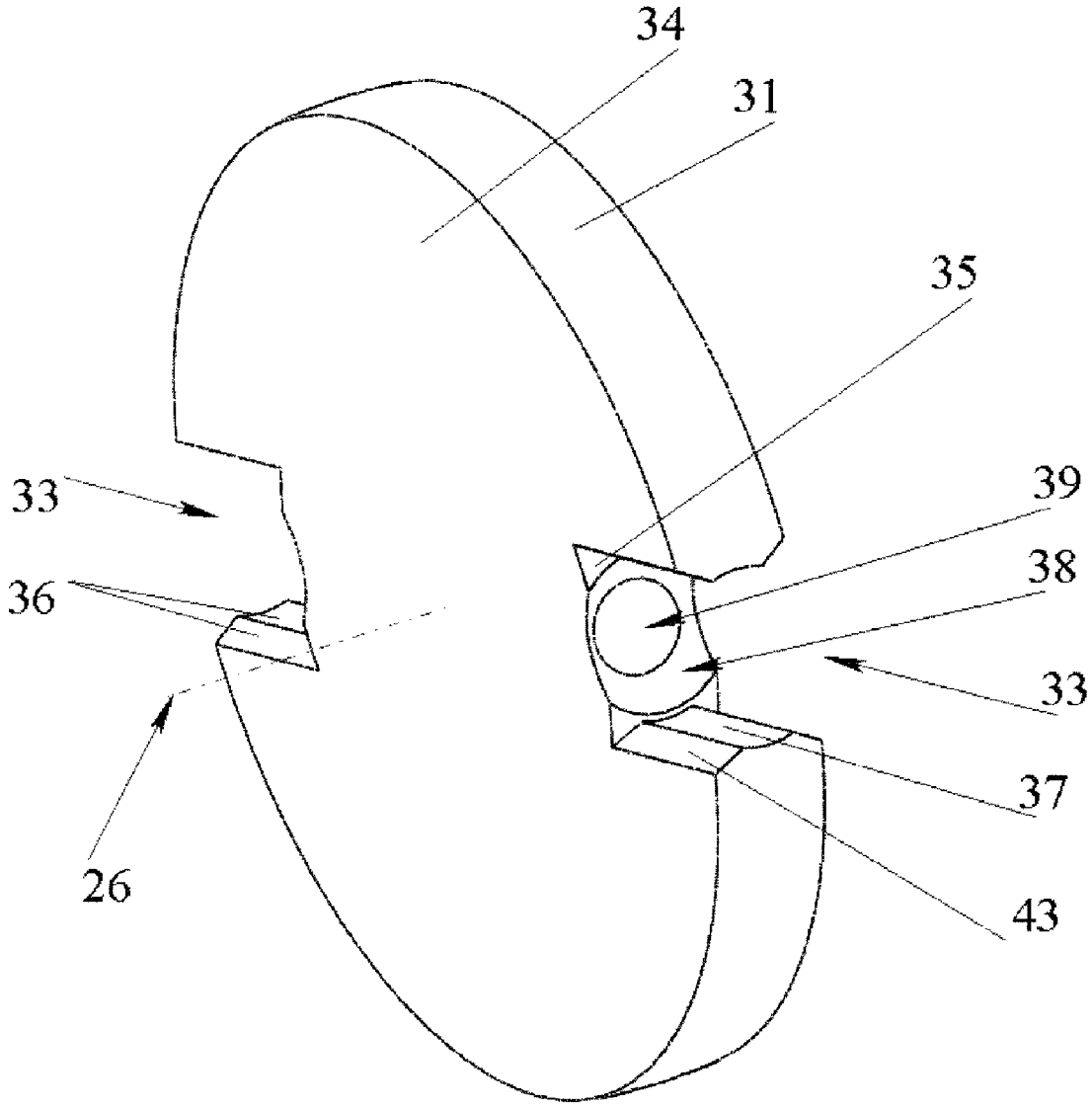
FIG. 4 shows an isometric view of the flat piston embodiment.

The piston 8 of FIG. 4 is made in the form of a flat disk (to provide its self-positioning in the spherical cavity 4 of the body 1, 2, 3 as well as in the slot 21 of the rotor 7) with the spherical side surface 31. The piston 8 end-faces 34 are made flat, although slight deviations (for example, the piston center rising and lowering to control moment of the piston 8 friction in the rotor 7 slot 21) as well as lubricating and unloading grooves, the hollows 57 for weight-reduction, the cavities for liquid (as in the hydraulic bearings) are allowed. The through-cutouts 33 for the SSE 44 mounting are made at the diametrically opposite sides of the disk. On the side surface 36 of the through-cutout 33 there is the cylindrical area 37, connected with the piston 8 end-faces 34 by the chamfers 43. The through-cutout 33 bottom 35 has the spherical area, at the center of which the cylindrical hole 39, going along the diameter of the piston 8, is made. At entries, the hole becomes conical 38. Besides, the cone 38 outgoes to the end-faces 34 of the piston 8. This allows to increase the SSE 44 base 52 to provide strength. In order to simplify manufacturing process, the cylindrical hole 39 can be made through and of uniform diameter. But more strength piston is obtained in case if the hole 39 of smaller diameter 62 passes through the piston center (for the SSE 44 pin 47).

Figure 5:
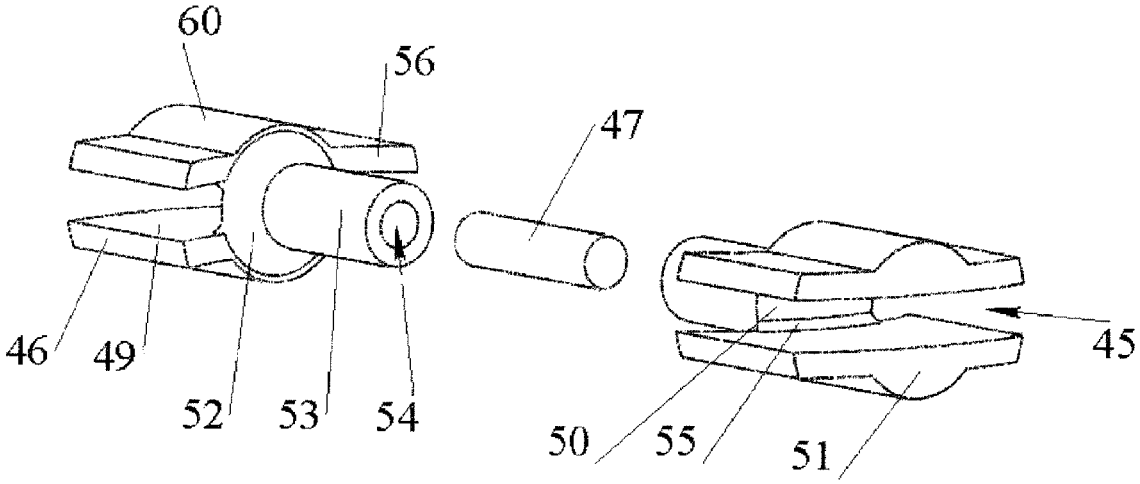
FIG. 5 shows an exploded view of the SSE for the flat piston embodiment.

FIG. 5 shows the disassembled SSE 44 for the piston 8 of FIG. 4. It consists of two similar ends joined by means of the pin 47. On the SSE 44 shaft 53 there is a conical base 52 with the cylindrical part 60 split by the through-cutout 45. The split cylindrical part 60 has the lugs 46, elongating the through-cutout 45. The through-cutout 45 bottom 50 is made in the form of a part of a sphere (for the sake of simplicity and in view of small sizes, it can be made in the form of the part of a cylinder or even flat). In order to minimize the SSE 44 loosening by the through-cutout 45, the chamfers 55 (fillets) are left between the through-cutout 45 bottom 50 and its side surfaces 49. At the opposite end of the SSE 44 shaft 53 the hole 54 is made for the pin 47 connecting two ends of the SSE 44. The diameter of the SSE 44 shaft 53 end, in which the pin 47 is pressed, is a bit (for example, by a few hundredths of millimeter) undersized. The cylindrical part 60 of the SSE 44 has the spherical end 51 to provide contact along the body 1 sphere 4 and the spherical opposite area 56 to provide contact over the sphere 18 of the rotor 7.

The area of the rotor 7 (FIG. 6), corresponding to one stage of the PDRM, is provided for operation with the piston 8 of FIG. 4 and the SSE 44 of FIG. 5. Between the input and output shaft 19 of the rotor 7 there is a spherical part 16, in equatorial part of which a circular slot is made. The slot bottom is presented by the central sphere 18, and the conical surfaces 17 serve as slot side surfaces. For simplicity, the rectangular (not taking into account the chamfered radii) through slot 21 is made symmetrically through the sphere 16 along the geometrical axis 6 of the rotor 7 rotation. The slot 21 can enter a little into the input and output shaft 19, and its short sides can be non-straight (for example, the arc). The chamfers 61 are made at the joint of the rotor 7 slot 21 and the central sphere 18 to provide tight passing of the SSE 44 conical base 52.

Such a design is simple enough. The assembly procedure is as follows. The piston 8 is inserted into the rotor 7 slot 21. The pin 47 is inserted into the piston 8 hole 39 (62) and then, two ends of the SSE 44 are inserted into the piston 8 hole 39 from the two sides and pressed onto the pin. Besides, the SSE 44 through-cutouts 45 are oriented in parallel. For better fixation, a thin layer of electrically-insulating lacquer can be applied on the piston 8 hole 39 (62) wall, and a thin oxide film can be created on the pin 47 surface (to increase the local resistance to the electric current). The SSE 44 ends and the pin 47 can be welded together by electric discharge from one end of the SSE 44 to the other one.

Figure 7:
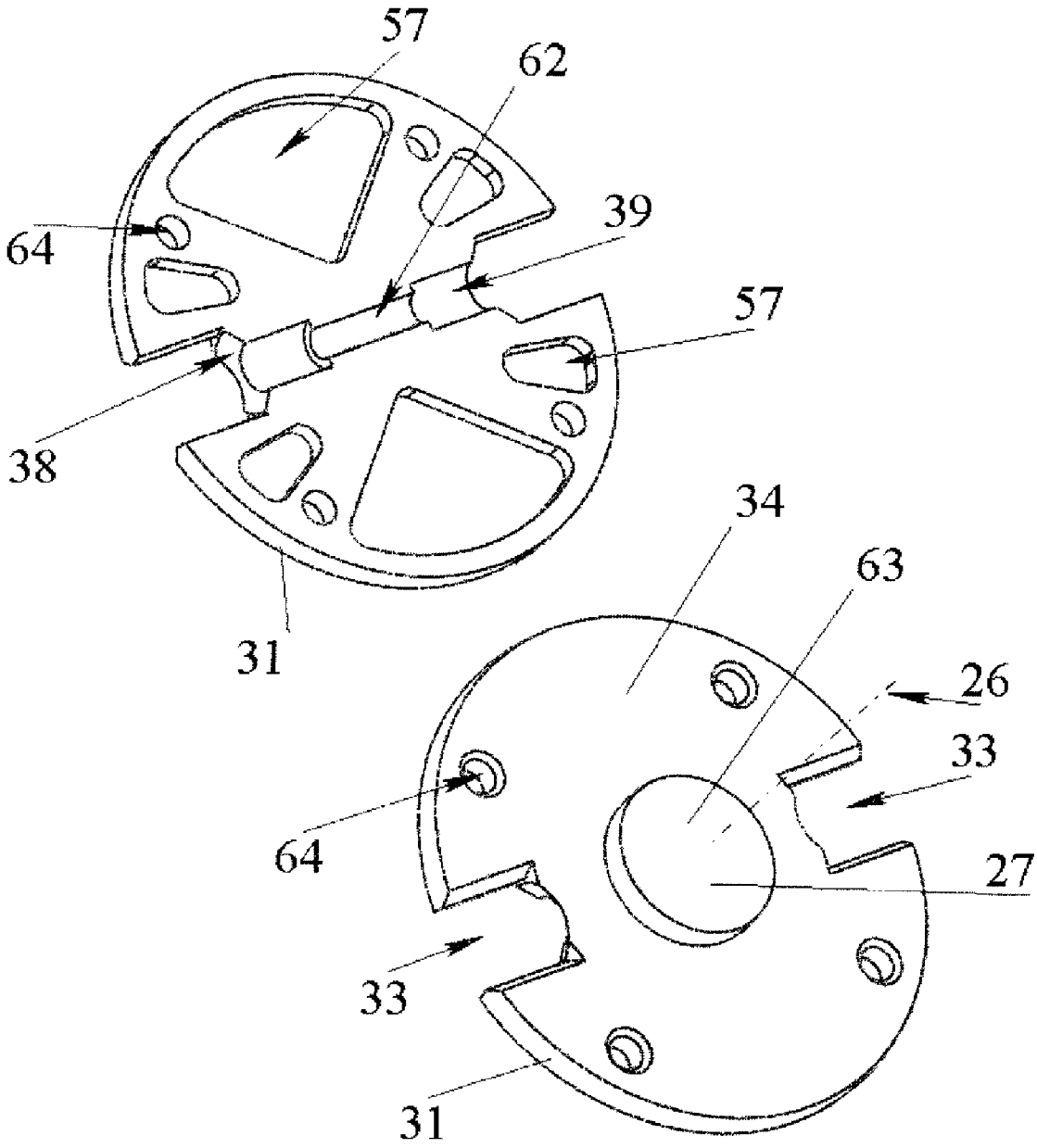
FIG. 7 shows an isometric view of the two parts of the flat piston embodiment with the boss.

The SSE 44 shaft decreases the strength of the piston 8 (by dividing it into two parts). In order to eliminate this disadvantage, the piston 8 (FIG. 7), consisting of two parts, is proposed. The dividing surface goes along the plane of the end-faces 34. Then the possibility of making a projecting area (boss) 63 on one of the parts at the center of the piston 8 appears. The main function of the boss 63 is the piston 8 strengthening due to increase in thickness at weak place. If required, the boss 63 can be used as the rotation shaft 27. At the same time, by the example of this piston, an example of the piston 8 weight-reduction by making the hollows 57 from inside is shown. The hollows 57 can be filled in with a lighter material. Two parts of the piston 8 can be fastened together, for example, by means of rivets through the holes 64 when inserted in the rotor 7 slot 21.

Figure 6:
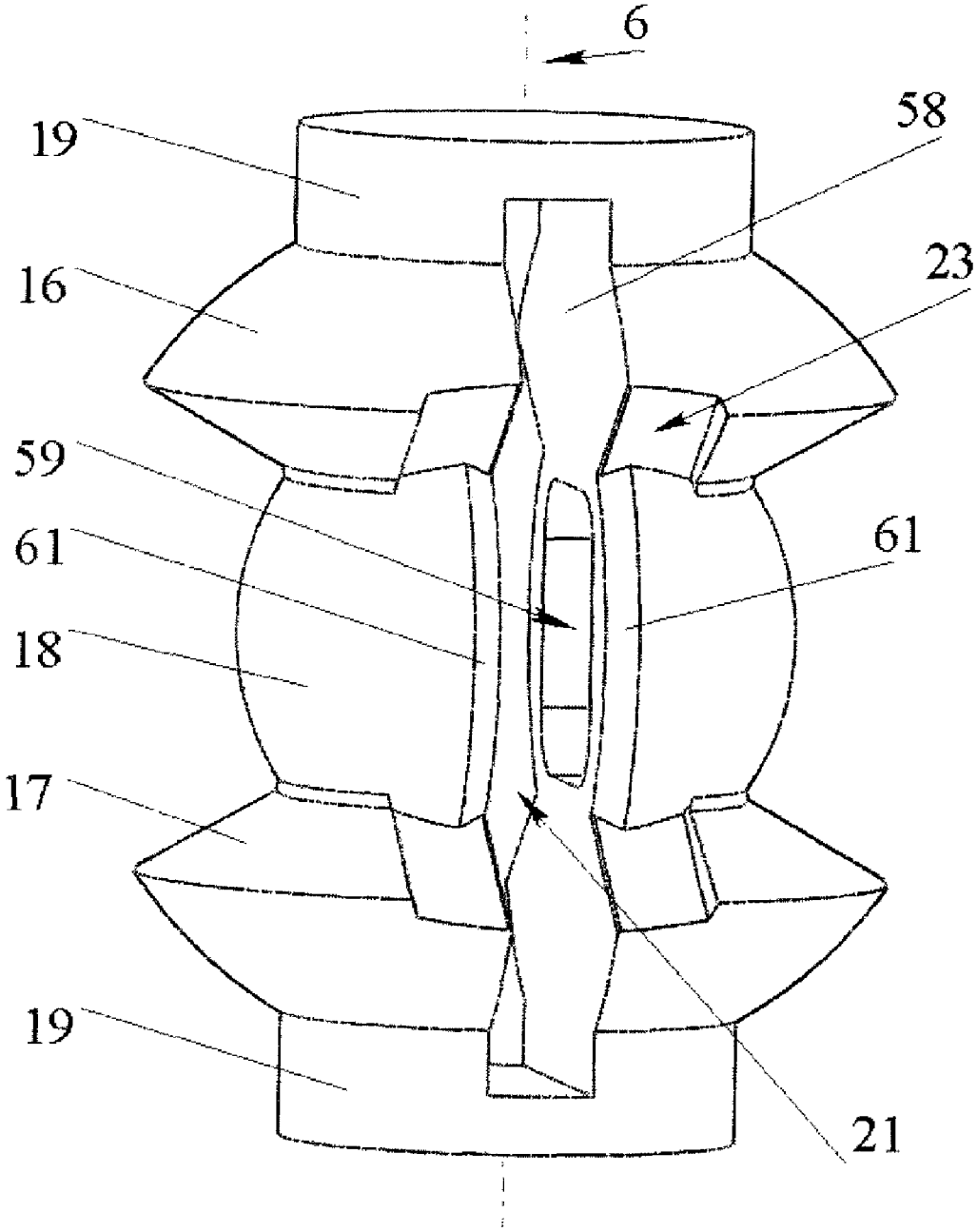
FIG. 6 shows an isometric view of the part of the rotor corresponding to one stage of the PDRM for the flat piston embodiment.

To provide operation using such piston 8, the recess 59 of optional form, sufficient for locating the boss 63, is made at the central part of the rotor 7 slot 21 at least at one of its sides (FIG. 6). If the self-positioning piston 8 is used, the boss 63 shall enter the recess 59, providing the sufficient clearance, and when using the boss 63 as the shaft 27, the clearance shall be small.

Since in this PDRM all the boundaries of volumes with different pressures represent areas (resulting in decrease of leakage and metal smearing by abrasive content liquid) instead of lines, except for the boundary between the SSE 44 conical base 52 and the rotor 7 chamfer 61 therefore this place is also desirable to be made in different way.

Figure 8:
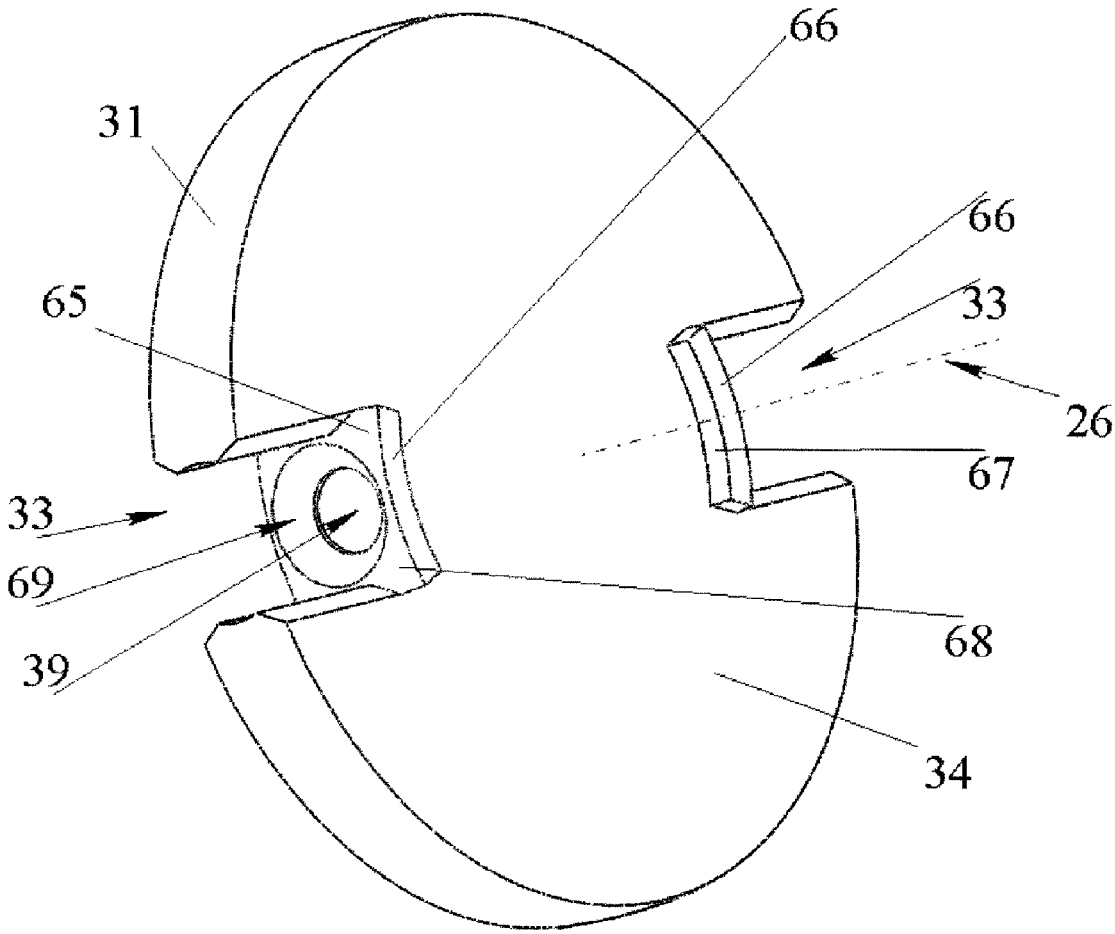
FIG. 8 shows an isometric view of the flat piston embodiment with the washers.
Figure 9:
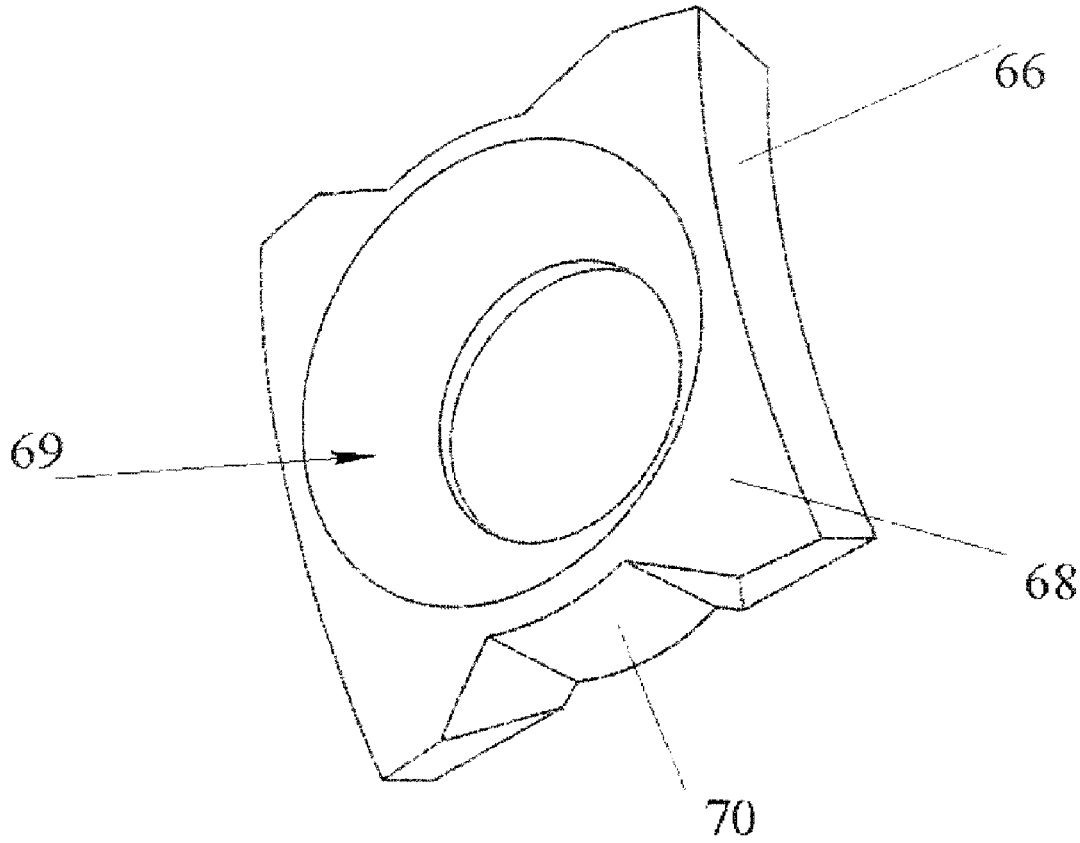
FIG. 9 shows an isometric view of the washer for the flat piston embodiment.
Figure 10:
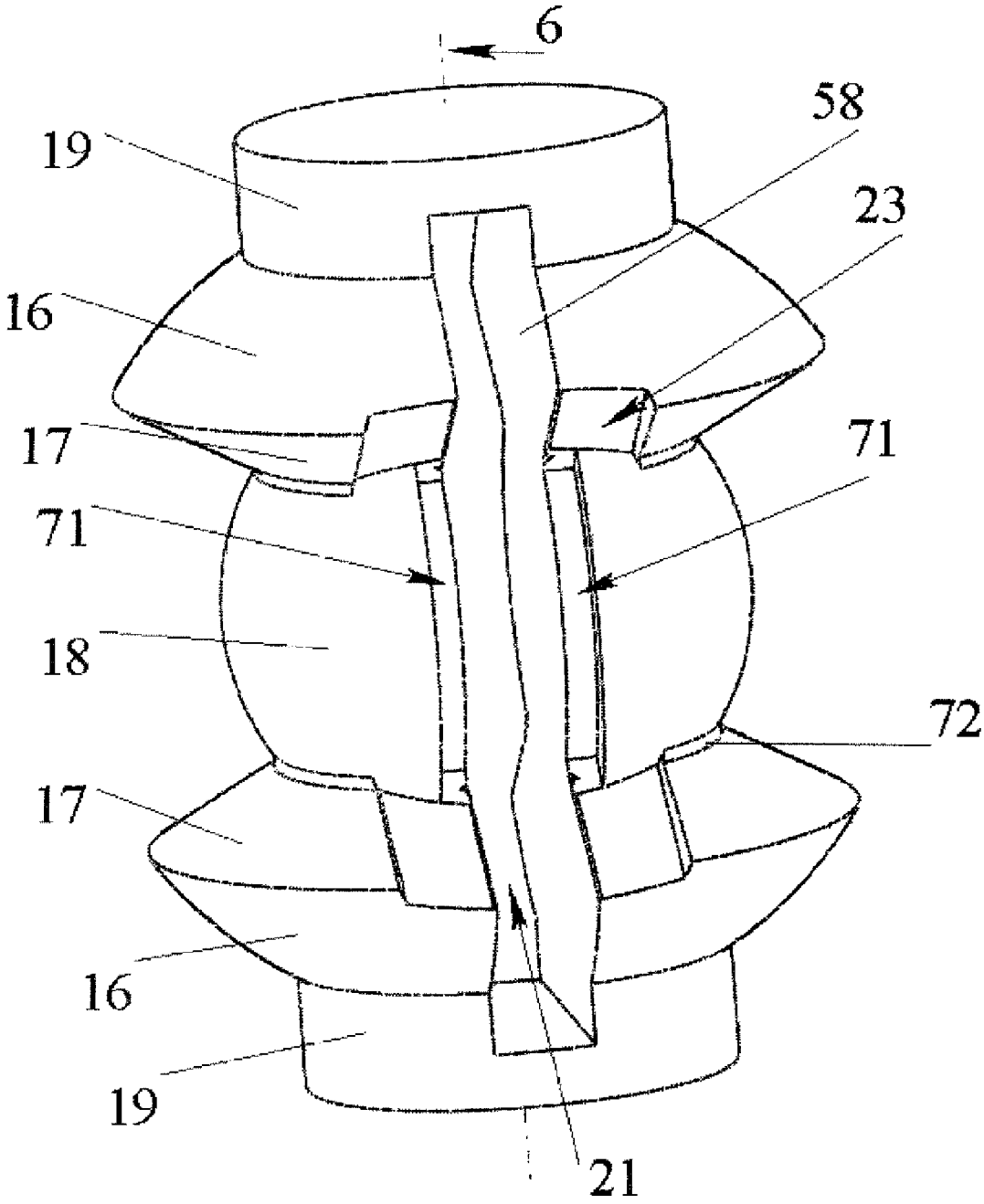
FIG. 10 shows an isometric view of the rotor embodiment of one stage for the flat piston with the washer.

FIG. 8 shows the piston 8 with the washer 65, which is mounted into the piston 8 through-cutout 33 after installing the piston into the rotor 7 slot 21. The washer 65 has four functional sides, two 66 of which are flat (conical) and two 70 have the form mating with the side surfaces of the piston 8 through-cutout 33 (to provide fixing in it). The washer 65 bottom 67 is cylindrical (can be spherical), top 68 is spherical. It has a conical (cylindrical) hole 69 for the SSE 44. In this case, the grooves 71 shall be made on the rotor 7 along the joint of the central sphere 18 and the slot 21 (FIG. 10). The piston 8 through-cutout 33 shall be deepened to provide the washer 65 location. The scaled-up washer 65 is shown at FIG. 9.

Figure 11:
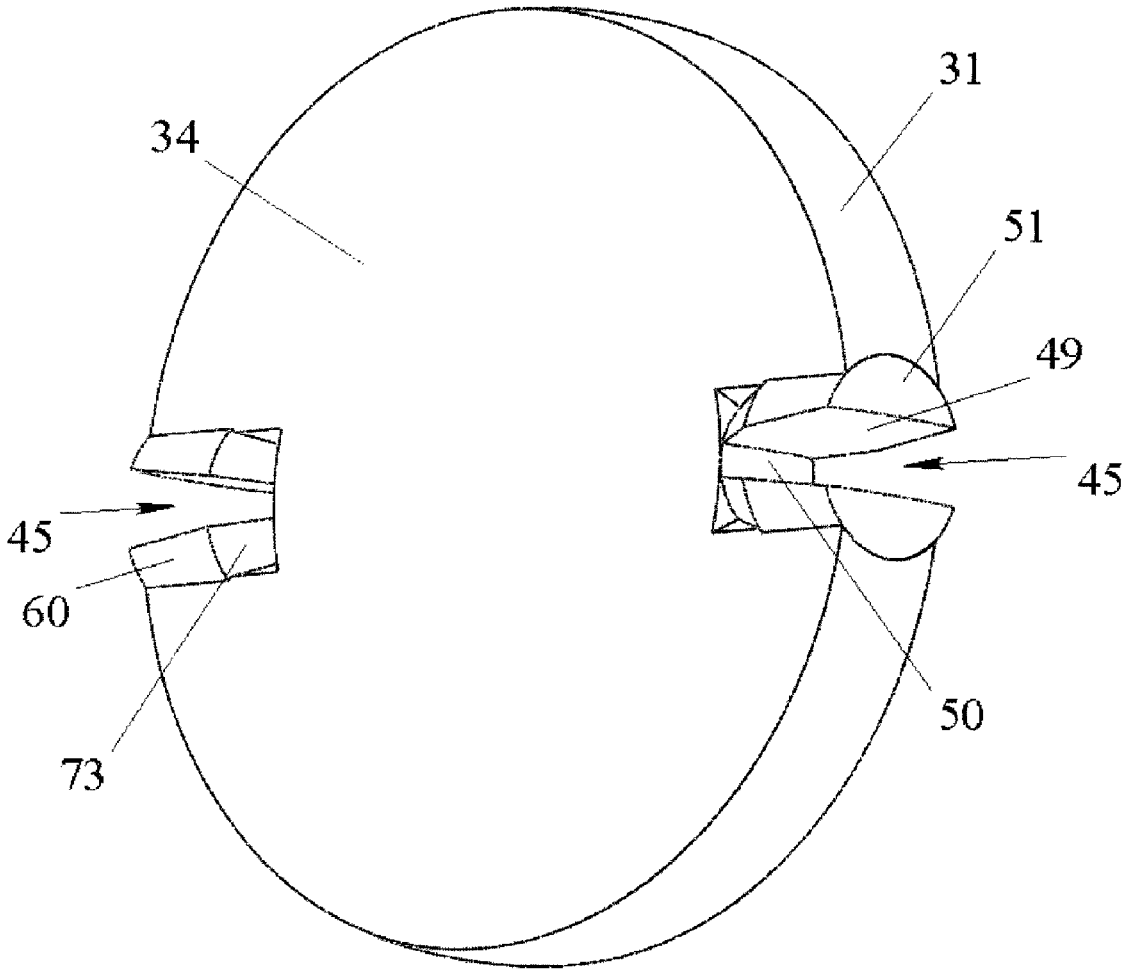
FIG. 11 shows an isometric view of the flat piston embodiment with the SSE without the lugs.

The piston 8 with the SSE 44 without the lugs 46 (FIG. 11) represents more cheap and tight embodiment, but its service life may be shorter for lack of the lugs 46. This SSE 44 is also different in that the through-cutout 45 has the profile narrowed towards the center of the piston 8. The SSE 44 base 52 does not break the piston 8 end-face 34 (the hole 38 fits into the through-cutout 33 bottom 35 area). The SSE 44 part, projected into the working chamber 20, is made in the form of a body of rotation, consisting of the cone 73 and the cylinder 60.

Figure 12:
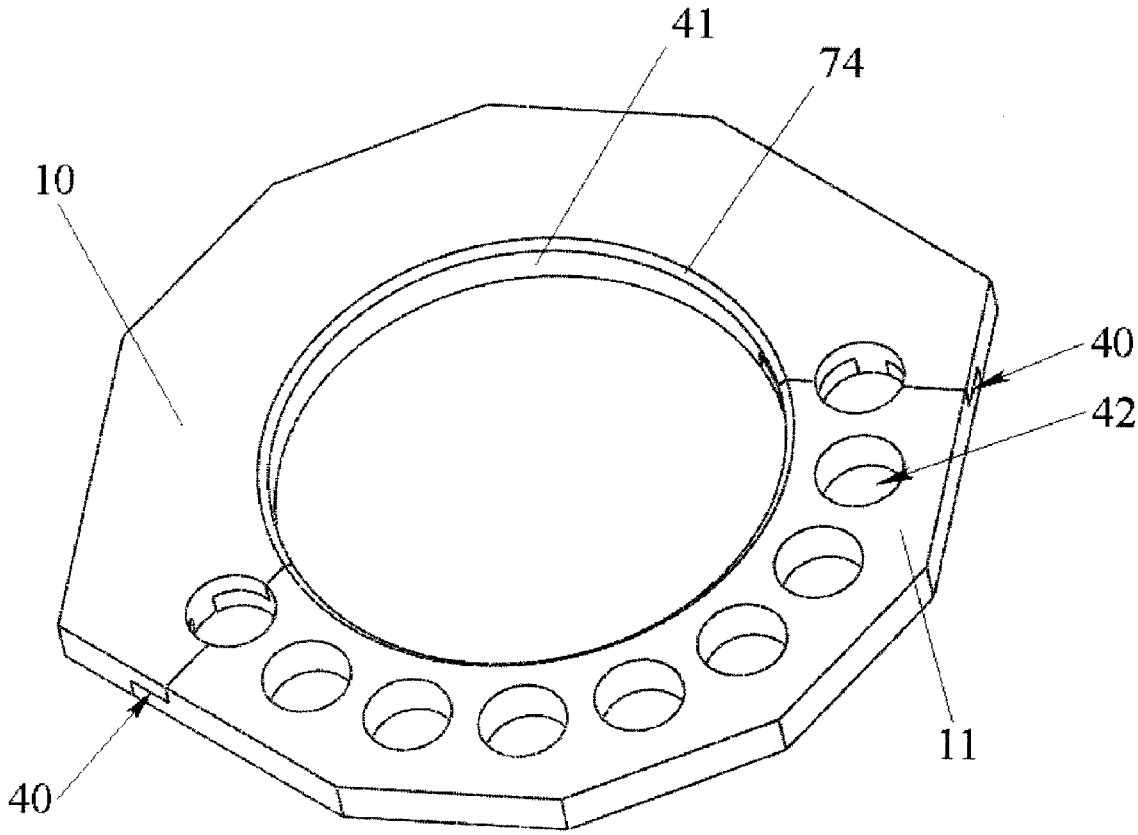
FIG. 12 shows an isometric view of another embodiment of the separator.

FIG. 12 shows the separator 9 made in the form of a polygon. Such a form simplifies the process of making the grooves on the body 1 spherical surface 4 to provide fastening the separator 9. To provide strength, the separator 9 is divided into two unequal parts. The part 11 (propulsion) with the through passes 42 is made smaller, as it is subjected only to longitudinal pressure differential load unlike the other part 10 (bypass). The joint 40 is made in the form of a step, intersecting the inner surface 41 of the separator 9 at diametrically opposite points (or somewhat further, on the propulsion area). At assembly, the joint 40 is desirable to be additionally fixed by contact welding or any other known means. The chamfer 74 is made at the joint between the inner spherical surface 41 and the side (flat) surface. In this case, the mating chamfer 72 is also made on the rotor 7 (FIG. 10).

Figure 13:
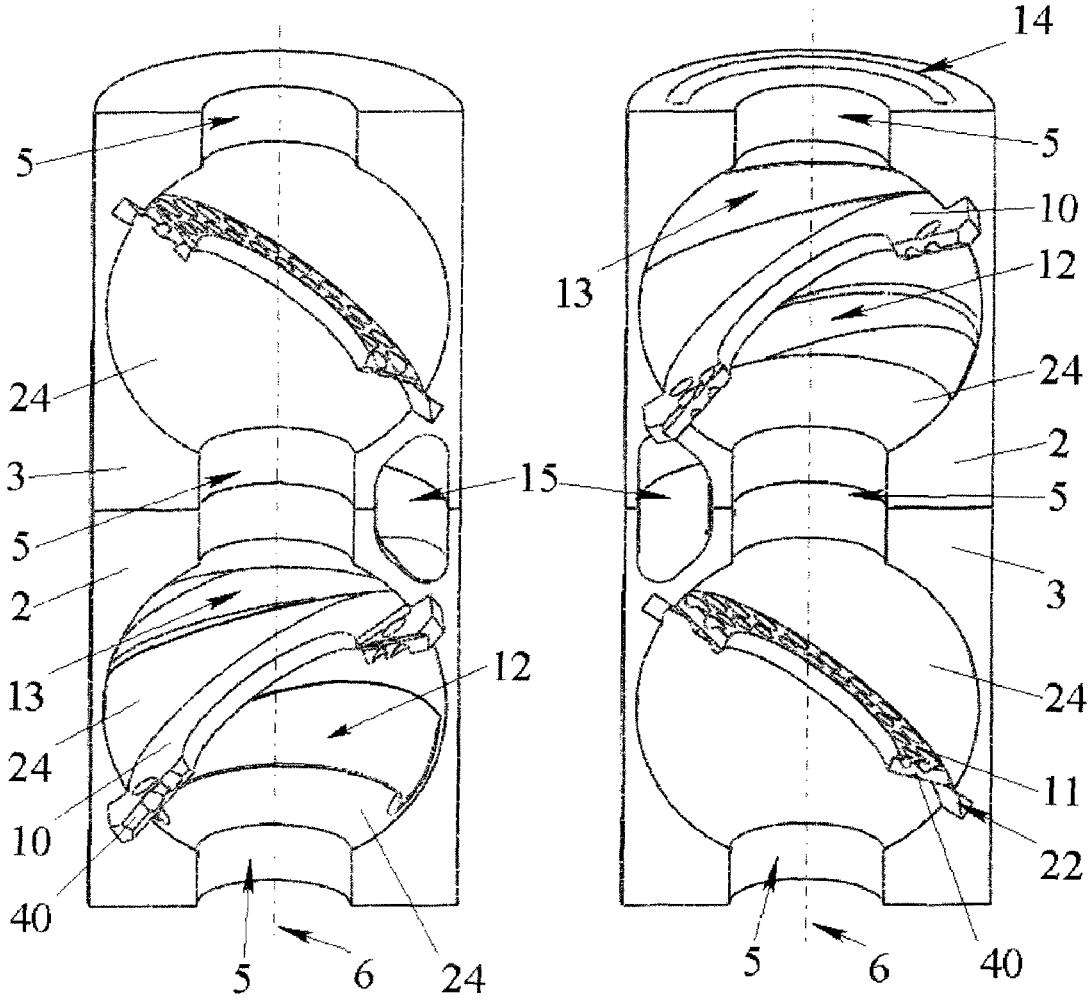
FIG. 13 shows an isometric view of an assembly of the bodies of the PDRM two stages of FIG. 1.
Figure 14:
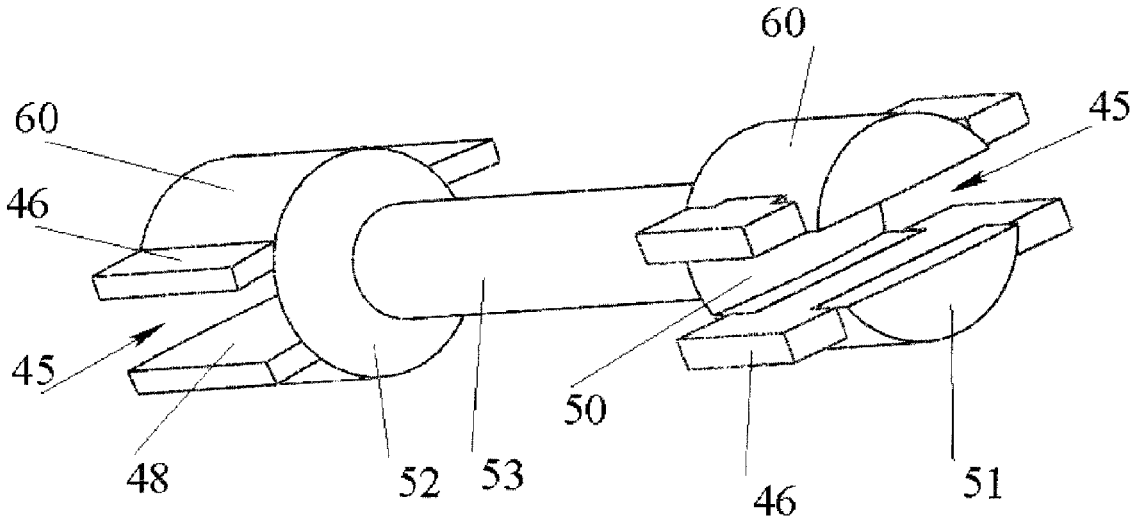
FIG. 14 shows an isometric close-up view of the SSE of FIG. 1.

FIG. 13 shows how two stages of the PDRM bodies of FIG. 1 are joined. Two stages are joined together, half-turned about the machine axis 6, to release the PDRM shaft from radial load. The machine with a large number of stages can be arranged of such blocks. For rigidity, the longitudinal half of the body, consisting of several stages, is desirable to be made solid (as each stage of the PDRM produces a sufficiently high pressure). However, it is often (depending on equipment available) not adaptable to manufacture. It is more important to make the rotor of multistage machine to be solid composed of two, four or more stages. It can be obtained just by combining the separate stages (without turning around).

Figure 15:
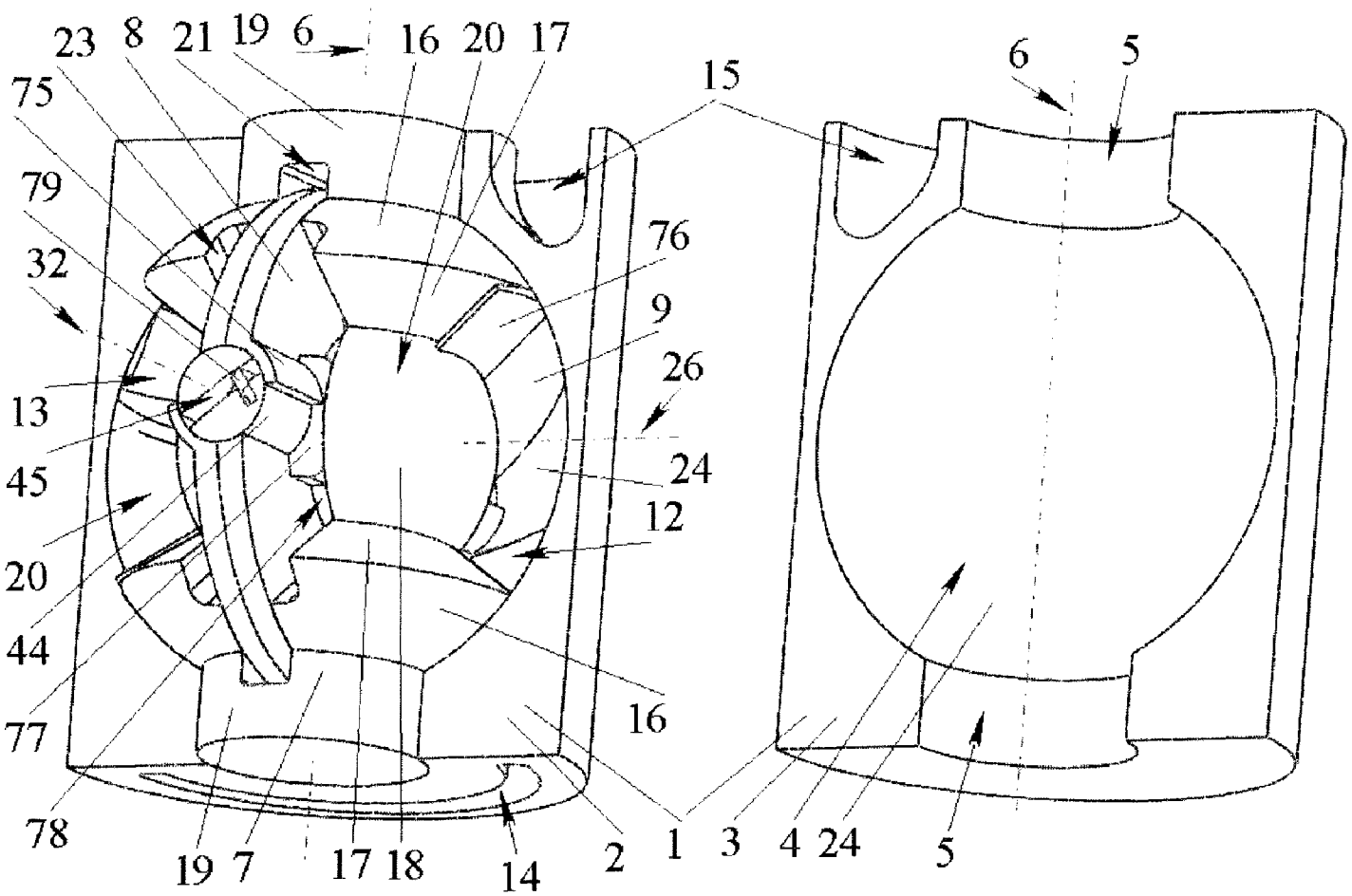
FIG. 15 shows an isometric view of the PDRM embodiment of FIG. 1, where the SSE through-cutout is closed off by the piston lug and, additionally, by the resilient member at the propulsion area.
Figure 16:
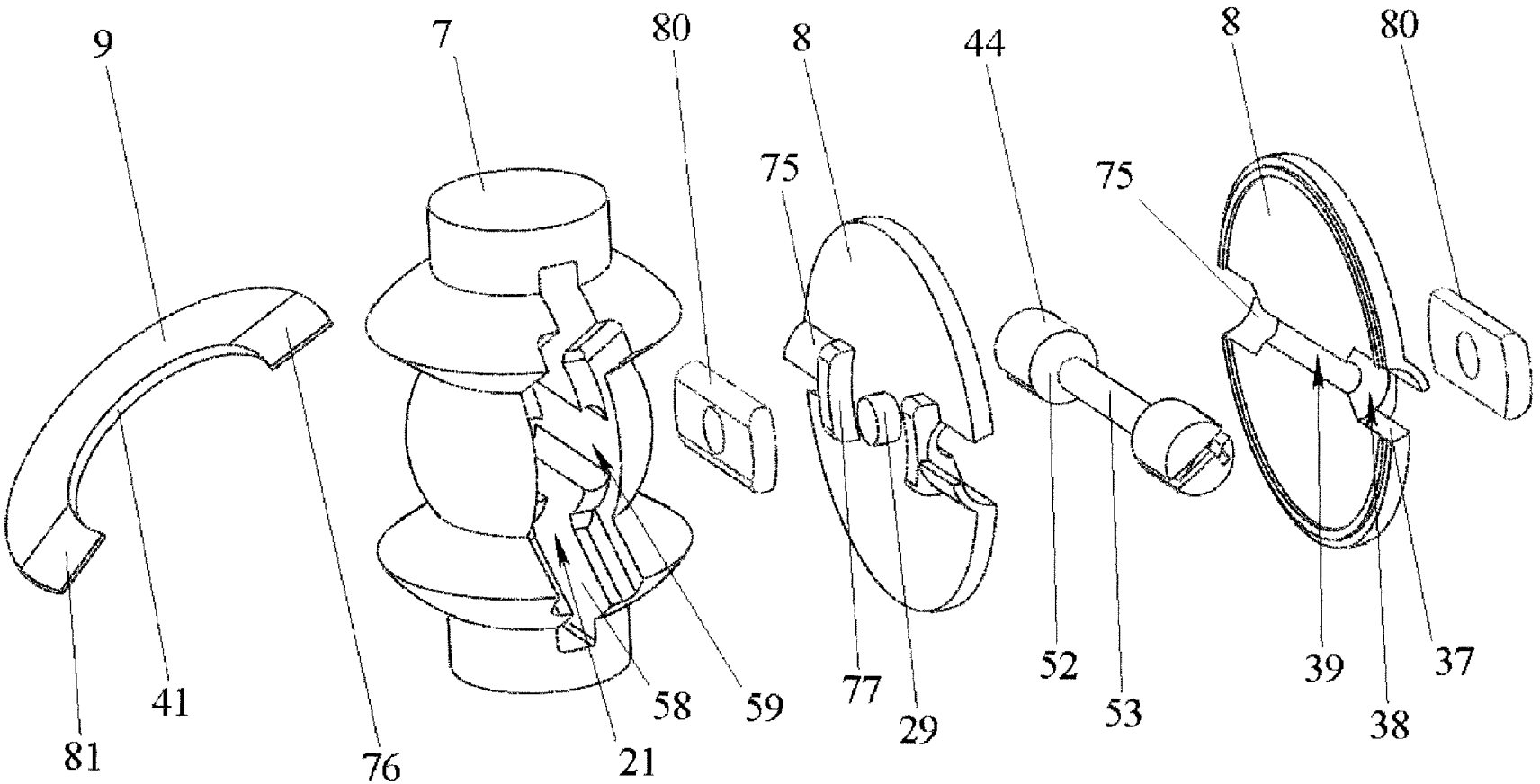
FIG. 16 shows an exploded view of the PDRM embodiment of FIG. 15, consisting of the separator, the rotor, the rotor inserts, the piston and the SSE.
Figure 17:
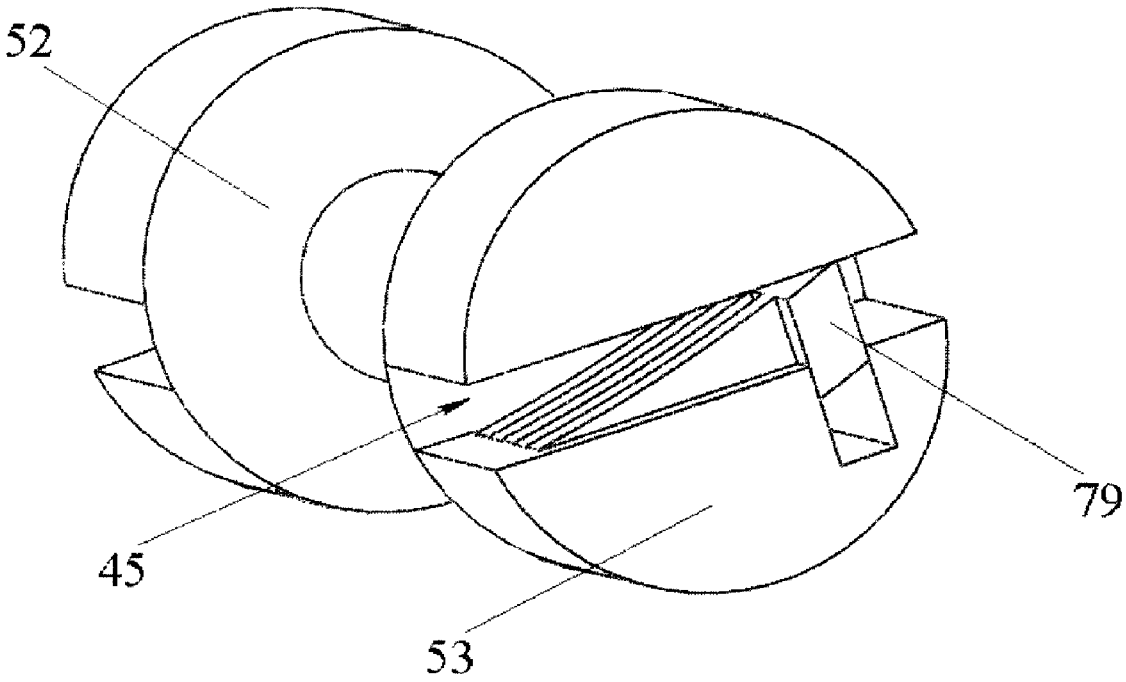
FIG. 17 shows an isometric close-up view of the SSE of FIG. 15.

The PDRM embodiment of FIG. 15 differs in the absence of the separator 9 descending area 11. Its function in the PDRM (FIG. 1) was limited to the SSE 44 through-cutout 45 closing off at the propulsion area, and it was referred to as the separator 9 as the extension (geometrical continuation not performing the same function) of the same component. But only the ascending area 19 of the separator 9 performs the function of separation of the chambers with different working medium pressures. In this PDRM embodiment, the SSE 44 through-cutout 45 is closed off by the piston 8 lug 75 (FIG. 16) at the SSE 44 turning around by the separator 9 (by the former ascending area 10) located at the opposite side of the piston 8. Besides, the SSE 44 lugs 46 had to be removed. To reduce back-flows (slippage) at the transition areas (FIG. 16)—the separator 9 entry 81 and exit 76, when the SSE 44 through-cutout 45 is not completely closed off by the lug 75, the resilient member 79 (FIG. 17), closing off the through-cutout 45 when there is no separator 9 in it, is mounted in the through-cutout 45 recess. The space under this member 79 is connected with the chamber in front of the piston so that working medium pressure does not influence its position. A force for the through-cutout 45 closing off can be obtained from working medium pressure by shifting forward the contact line between the resilient member 79 and the SSE 44 upper area. As for the rest, this PDRM embodiment does not differ from the embodiment of FIG. 1.

Figure 19:
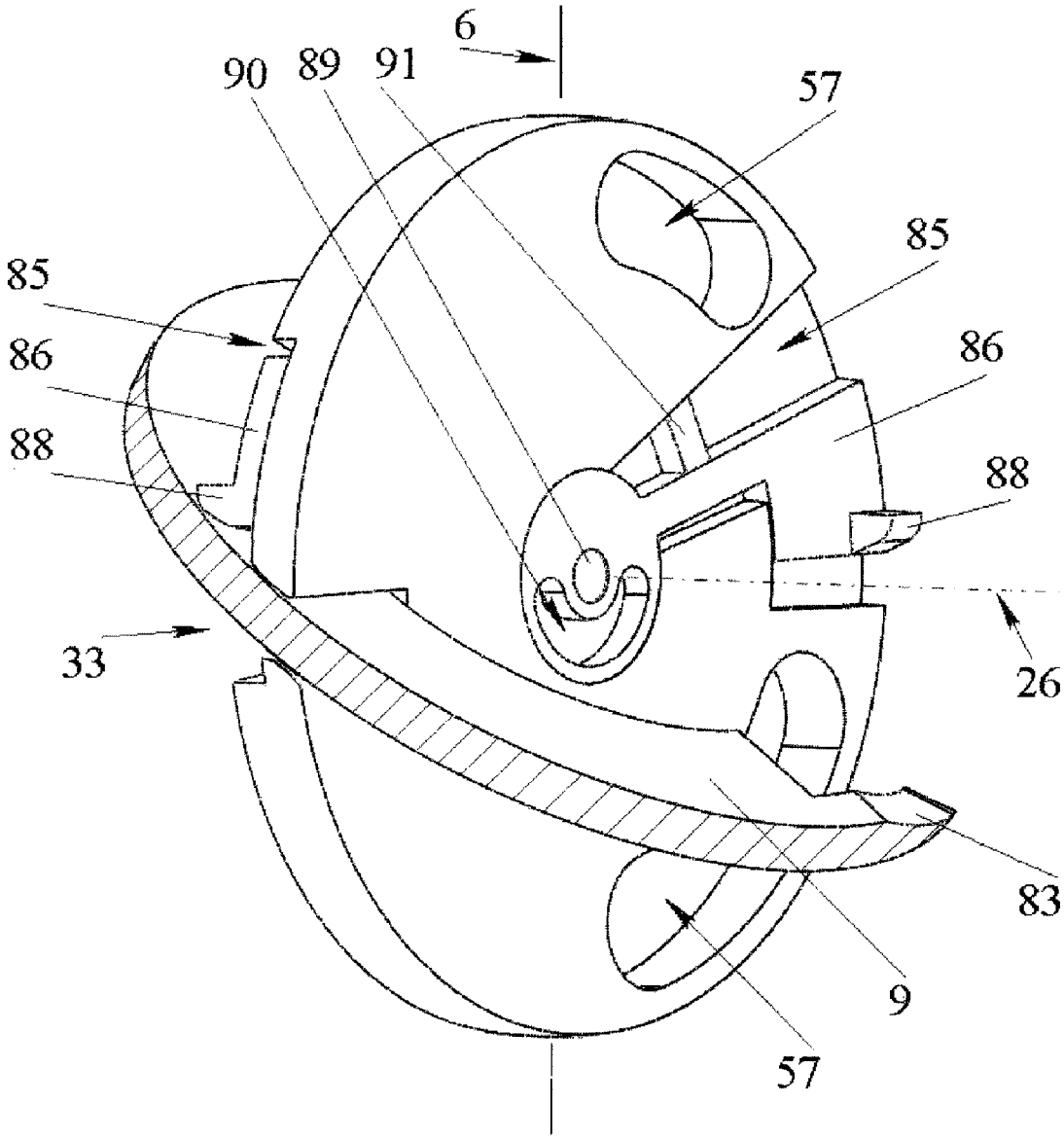
FIG. 19 shows an exploded view of the PDRM embodiment of FIG. 18, consisting of the separator, the piston and the shutters.

The PDRM embodiment of FIG. 18 differs from the embodiment of FIG. 15 in the absence of the SSE 44. Its role in the piston 8 through-cutout 33 closing off plays a new member—the shutter 86. To accommodate it, the cutout 85, representing the cylindrical recess in the center connected with the recess of sector form going to the through-cutout 33, is made on the flat part of the piston (FIG. 19). The shutter 86, representing a disk connected with the area by a leg, is rotatably mounted in the cutout 85. The far side of the area is limited by the spherical surface to provide sealing along the body sphere 24. The near side is also limited by the sphere, but of smaller radius to provide contact along the spherical bottom of the piston 8 through-cutout 33. The groove 90 in the form of an arc is made along the circular part of the shutter 86. The similar cutout 85 is made at the opposite end-face of the piston 8 from its opposite side (symmetrically to vertical axis), and one more shutter 86 is located in it. Two shutters 86 can be immovably joined together by means of the shaft 89 passed through the hole at the center of the piston 8 or spring-loaded towards the through-cutout 33 closing off by means of the resilient member 91. The pin, pressed in the rotor 7 hole (not shown), is installed in the rotor 7 slot 21 so that it projects into the shutter 86 groove 90. It is aimed to stop the shutter 86 at a height, at which the shutter 86 does not crash against the entry 83, at the piston 8 through-cutout 33 movement downwards (that is to open the through-cutout 33 before the separator 9). Additionally, the shutter can have the lug 88, and the separator—the entry 83 for the shutter 86 as well as the exit 84. The form of the lug 88 working surface looks like a part of cosine function. That is the initial area along travel speed, and further the angle is changed. The shutter is opened at running on the entry 83. The lug 88 at one of the shutters 86 is fastened to it by any known means after it is inserted into the rotor 7 slot 21. It is enough to have one of the described shutter 86 opening systems. If two shutters 86 are immovably connected by means of the shaft 89, opening (raise) of one of them by the separator 9 results in a forced closing (lowering) of the other. Additionally, places for the piston 8 hollows 57, effectively reducing its inertia to decrease inertial load on the separator 9, are shown in FIG. 19. The places, close to the plane of the separator 9, little impose inertial load, as they go along the natural paths under centrifugal inertial forces. The rotor 7 slot 21 is made flat.

The PDRM embodiment of FIG. 20 differs from the embodiment of FIG. 18 in somewhat different design of the shutter 86. Its area, closing off the piston 8 through-cutout 33, does not lie in the piston 8 cutout 85, but is placed on the flat end-face 28 of the piston 8. It is done so that the cutout 85 does not reduce the working area of the piston 8 through-cutout 33. Although to enable assembling, the area of the shutter 86 has to be fastened to the leg after inserting the piston 8 into the rotor 7 slot 21 or the insert has to be used.

The bodies 1 of the PDRM embodiments of FIGS. 15, 18 and 20 do not differ from each other, and except for the absence of the slot 22 for the separator 9 at the propulsion part 3 do not differ from the body 1 of the PDRM of FIG. 1. Just in the same way their stages can be combined. The rotors 7 are also similar.

At accurate making of these PDRM, their pistons can be provided with the shafts. This can increase its service life.

The PDRM embodiment of FIG. 1 operates as follows. At the rotor 7 rotation, one of the piston 8 parts, projecting into the working cavity 20 at the descending area 3 of the body 1, closes off the working cavity 20 dividing it into two working chambers: of decreasing volume (in front of the piston 8) and increasing volume (behind the piston 8). Besides, the piston 8 through-cutout 33 is closed off by the SSE 44 and the separator area 11 with the through passes 42. Moreover, the separator area 11 does not block working medium movement within the working cavity 20 along the direction of the rotor 7 rotation. The working medium is expelled out of the decreasing working chamber through the outlet opening 13 at the ascending area 10, and being drawn into the increasing working chamber through the inlet opening 12 at the ascending area 10. Moreover, the piston 8 turns around relative to the rotor 7, interacting with the separator 9 by means of the through-cutout 33 via the SSE 44. At getting this part of the piston 8 into the bypass area (inlet 12/outlet 13 openings) at once or after a while its place is taken by the next projecting part of the piston 8. The process is repeated. Besides, it should be noted that the PDRM inertial loads are produced by the part of the piston 8, distant from the SSE 44 axis 32. The SSE 44 itself and the nearest to it part of the piston 8 would oscillate at a period, close to the rotor rotation period, under effect of centrifugal forces. Thus, at weight-reduction of the part of the piston 8 distant from the SSE 44 axis 32 being done, the PDRM can operate at very high rpm as the piston oscillations are, mainly provided for by centrifugal forces.

The PDRM embodiment of FIG. 15 operates as follows. At the rotor 7 rotation, one of the piston 8 parts, projecting into the working cavity 20 at the descending area 3 of the body 1, closes off the working cavity 20 dividing it into two working chambers: of decreasing volume (in front of the piston 8) and increasing volume (behind the piston 8). Besides, the piston 8 through-cutout 33 is closed off by the SSE 44 and the piston 8 lug 75. The working medium is expelled out of the decreasing working chamber through the outlet opening 13 at the ascending area 10, and being drawn into the increasing working chamber through the inlet opening 12 at the ascending area 10. Moreover, the piston 8 turns around relative to the rotor 7, interacting with the separator 9 at the ascending part of the body by means of the through-cutout 33 via the SSE 44. At getting this part of the piston 8 into the bypass area (inlet 12/outlet 13 openings) at once or after a while, its place is taken by the next projecting part of the piston 8. Besides, the SSE 44 is turned around by the separator on the other side of the piston and soon its through-cutout 45 becomes closed off by the piston 8 lug 75. Before this moment at the separator 9 exit 76, the through-cutout 45 is closed off by the resilient member 79. After passing through the descending propulsion area of the body 3, the through-cutout 45 of the SSE 44, turned around by the separator 9, goes out of the region of closing off by the piston 8 lug 75. The entry 81 of the separator 9 enters the through-cutout 45 and bends away the resilient member 79. The process is repeated.

The PDRM embodiment of FIG. 18 operates as follows. At the rotor 7 rotation, one of the piston 8 parts, projecting into the working cavity 20 at the descending area 3 of the body 1, closes off the working cavity 20 dividing it into two working chambers: of decreasing volume (in front of the piston 8) and increasing volume (behind the piston 8). Besides, the piston 8 through-cutout 33 is closed off by the shutter 86. The working medium is expelled out of the decreasing working chamber through the outlet opening 13 at the ascending area 10, and being drawn into the increasing working chamber through the inlet opening 12 at the ascending area 10. Moreover, the piston 8 turns around relative to the rotor 7, interacting with the separator 9 at the ascending part 2 of the body 1 by means of the through-cutout 33. At getting this part of the piston 8 into the bypass area (inlet 12/outlet 13 openings) at once or after a while, its place is taken by the next projecting part of the piston 8. Besides, at the piston 8 through-cutout 33 coming closer to the entry 83, the pin inside the rotor 7 slot 21 comes up to the end of the shutter 86 groove 90 and stops it in the position when it does not close off the piston 8 through-cutout 33. In case of wearing of this mechanism, the shutter runs onto the entry 83 of the separator 9 with its lug and is opened as well. Further, the separator 9 lifts the shutter, which, being rigidly connected by means of the shaft with the shutter at the opposite end-face of the piston 8, entering the propulsion part of the body at this moment, lowers it, closing at the same time the through-cutout 33. In case of non-rigid connection between two shutters 86, the shutters 86 are closed due to centrifugal force and/or the resilient member 91. The process is repeated.

The PDRM embodiment of FIG. 20 operates similarly to the PDRM embodiment of FIG. 18, except for the absence of the lug 88 and the resilient member 91.

The invention claimed is:

1. A positive displacement rotary machine, comprising:

a body with an internal sphere-like working surface, conventionally divided into bypass and propulsion areas, a rotor with a working surface of rotation, rotatably mounted in the body, a ring working cavity, formed by the working surfaces of the body and the rotor, a C-shaped separator, mounted in a part (along rotation of the rotor) of the ring working cavity at an angle to a plane of the rotor rotation and fixed at the body, wherein the working cavity is partitioned by the separator into two parts at the bypass area of the body, and working medium inlet and outlet openings are located from the opposite sides of the separator, wherein at least one slot is made on the working surface of the rotor, mainly along a geometrical axis of the rotor rotation, in each slot of the rotor is mounted a piston closing off (sealing) the working cavity and performing rotational oscillations in a slot plane, and wherein the piston is made at least in the form of a part of a disk and there is at least one through-cutout for a separator passage, and a means for closing off the piston through-cutout at the propulsion area of the body.

2. The positive displacement rotary machine according to claim 1, wherein the working surface of the rotor is made in the form of two coaxial surfaces of truncated cones, rested with their truncated parts against a sphere.

3. The positive displacement rotary machine according to claim 1, wherein the slots on the rotor working surface are connected at a center of the rotor.

4. The positive displacement rotary machine according to claim 1, wherein the separator is made in the form of a flat washer part.

5. The positive displacement rotary machine according to claim 1, wherein the separator is made in the form of a washer part with a conical working surface.

6. The positive displacement rotary machine according to claim 1, wherein the separator is mounted in the body so that the separator touches the rotor by diametrically opposite parts, located at opposite ends of the separator.

7. The positive displacement rotary machine according to claim 6, wherein recesses are made on the separator at places of contact with the rotor.

8. The positive displacement rotary machine according to claim 1, wherein at least one seal synchronizing element is mounted in the piston through-cutout.

9. The positive displacement rotary machine according to claim 1, wherein the means for the piston through-cutout closing off comprises an extension of the separator with through passes, interacting with the piston via a seal synchronizing element (SSE).

10. The positive displacement rotary machine according to claim 1, wherein the means for the piston through-cutout closing off comprises a lug of the piston, interacting with a seal synchronizing element (SSE).

11. The positive displacement rotary machine according to claim 1, wherein the means for the piston through-cutout closing off comprises a seal synchronizing element (SSE) with a resilient member installed in the SSE through-cutout.

12. The positive displacement rotary machine according to claim 1, wherein the means for the piston through-cutout closing off comprises a shutter, mounted at the piston.

13. The positive displacement rotary machine according to claim 12, wherein a means of opening of the shutter comprises an element of the rotor.

14. The positive displacement rotary machine according to claim 12, wherein the means of opening of the shutter comprises an entry of the separator.

15. The positive displacement rotary machine according to claim 1, wherein the machine is made as multistage and wherein a multistage rotor is made as one unit for all stages.

16. The positive displacement rotary machine according to claim 15, wherein ducts for the working medium flow half-turning around the rotor are made in the body after a first stage and further at intervals of two stages.

17. A method of operation of a positive displacement rotary machine, said machine comprising a body with an internal sphere-like working surface, conventionally divided into bypass and propulsion areas, a rotor mounted in the body and having at least one piston with at least one through-cutout for a C-shaped separator passage, wherein a ring working cavity is partitioned into two parts at the bypass area of the body by means of the C-shaped separator, said method comprising the next step:

drawing a working medium into an increasing working cavity of the bypass area of the body through an inlet opening, located from one of sides of the C-shaped separator, pushing the working medium by a projecting part of the piston with a through-cutout at an area of the body without the separator and expelling out of a decreasing working cavity through an outlet opening, located from the other side of the separator.

18. The method of operation according to claim 17, wherein the piston through-cutout is being closed off during the piston passing through the propulsion area of the body.

19. The method of operation according to claim 18, wherein the piston through-cutout is being closed off by means of a part, representing the extension of the separator with through passes to its opposite side.

20. The method of operation according to claim 18, wherein the piston through-cutout is being closed off by means of a seal synchronizing element (SSE) at SSE rotation relative to the piston due to interaction with the separator.

21. The method of operation according to claim 18, wherein the piston through-cutout is being closed off by means of a controlled shutter.

22. The method of operation according to claim 21, wherein the shutter is opened by pressing against a rotor element.

23. The method of operation according to claim 17, wherein the piston through-cutout is being left non-closed off, and the cavity is sealed due to working medium hydraulic resistance.

* * * * *